US010850874B2

(12) United States Patent
Boldrini

(10) Patent No.: US 10,850,874 B2
(45) Date of Patent: Dec. 1, 2020

(54) MACHINE AND METHOD FOR PRODUCING ELECTRONIC-CIGARETTE CARTRIDGES

(71) Applicant: G.D SOCIETA' PER AZIONI, Bologna (IT)

(72) Inventor: Fulvio Boldrini, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 929 days.

(21) Appl. No.: 15/125,253

(22) PCT Filed: Mar. 20, 2015

(86) PCT No.: PCT/IB2015/052064

§ 371 (c)(1),
(2) Date: Sep. 12, 2016

(87) PCT Pub. No.: WO2015/140768

PCT Pub. Date: Sep. 24, 2015

(65) Prior Publication Data

US 2018/0170588 A1 Jun. 21, 2018

(30) Foreign Application Priority Data

Mar. 21, 2014 (IT) ..... BO2014A0147

(51) Int. Cl.
*B65B 3/06* (2006.01)
*A24F 47/00* (2020.01)
(Continued)

(52) U.S. Cl.
CPC ..... *B65B 3/06* (2013.01); *A24F 47/008* (2013.01); *B65B 3/28* (2013.01); *B65B 7/28* (2013.01);
(Continued)

(58) Field of Classification Search
CPC .. B65B 3/06; B65B 7/28; B65B 43/52; B65B 3/28; B65B 43/44; B65B 43/54;
(Continued)

(56) References Cited

U.S. PATENT DOCUMENTS 1,300,754 A * 4/1919 Miller ..... B65B 61/26 53/131.3
2,548,707 A * 4/1951 Cozzoli ..... B67C 3/04 141/156
(Continued)

FOREIGN PATENT DOCUMENTS

AU 2013205041 A1 5/2013
DE 10 242 118 A1 11/2003
(Continued)

OTHER PUBLICATIONS

International Search Report for Application No. PCT/IB2015/052064, dated Sep. 14, 2015.

*Primary Examiner* — Nathaniel C Chukwurah
*Assistant Examiner* — Mobeen Ahmed
(74) *Attorney, Agent, or Firm* — Marshall, Gerstein & Borun LLP

(57) ABSTRACT

Machine and method for producing electronic-cigarette cartridges; being provided: a fill conveyor which feeds bottom shells of the cartridges along a fill path; a filling device located along the fill path to feed a measure of a liquid substance downwards into each bottom shell; an assembly conveyor which feeds bottom shells along an assembly path; a transfer station where the bottom shells are transferred from the fill conveyor to the assembly conveyor; and at least a first assembly device located along the assembly path to fit each bottom shell with a corresponding top cap.

16 Claims, 22 Drawing Sheets

(51) Int. Cl.

| | |
|---|---|
| ***B65B 43/52*** | (2006.01) |
| ***B65B 3/28*** | (2006.01) |
| ***B65B 7/28*** | (2006.01) |
| ***B65B 43/44*** | (2006.01) |
| ***B65B 43/54*** | (2006.01) |
| *B65B 3/02* | (2006.01) |
| *B65B 3/04* | (2006.01) |
| *B65B 43/42* | (2006.01) |

(52) U.S. Cl.
CPC ..... *B65B 7/2821* (2013.01); *B65B 43/44* (2013.01); *B65B 43/52* (2013.01); *B65B 43/54* (2013.01); *B65B 3/02* (2013.01); *B65B 3/027* (2013.01); *B65B 3/04* (2013.01); *B65B 43/42* (2013.01)

(58) Field of Classification Search
CPC ..... B65B 7/2821; B65B 3/02; B65B 3/027; B65B 3/04; B65B 43/42; A24F 47/008
USPC ..... 53/471, 281, 282, 502, 415, 136.1
See application file for complete search history.

(56) References Cited

U.S. PATENT DOCUMENTS 3,309,836 A * 3/1967 Hallowell, Jr. ..... B67B 5/00 53/478
3,336,722 A * 8/1967 Van Der Winden ..... B67C 7/0073 53/426
3,491,511 A * 1/1970 Nigrelli ..... B65B 21/24 156/539
4,077,180 A 3/1978 Agent et al.
4,109,446 A * 8/1978 Krohn ..... B67C 7/002 53/282
4,697,691 A * 10/1987 Zodrow ..... B65G 47/681 198/418.5
4,782,644 A * 11/1988 Haarer ..... A24C 5/00 53/253
5,437,361 A * 8/1995 Ohmori ..... B67B 3/062 198/465.1
5,447,007 A * 9/1995 Reil ..... B65B 55/027 53/133.2
5,487,253 A * 1/1996 Hieltscher ..... B65B 55/10 53/281
5,915,524 A * 6/1999 Horlacher ..... B65B 59/005 198/473.1
6,119,848 A * 9/2000 Hartness, III ..... B65G 23/14 198/833
6,152,291 A * 11/2000 Steeber ..... B65G 47/5131 198/594
6,276,409 B1 * 8/2001 Ellison ..... B65B 21/04 141/178
6,733,224 B1 * 5/2004 Linner ..... B65B 3/16 294/87.1
7,059,104 B2 * 6/2006 Taylor ..... B65B 3/34 53/130.1
7,089,715 B2 * 8/2006 Topf ..... B67B 3/062 198/608
7,331,156 B2 * 2/2008 Hartness ..... B65G 17/323 198/470.1
7,937,907 B2 * 5/2011 Fleckenstein ..... B65B 3/003 53/268
8,322,514 B2 * 12/2012 Bonnain ..... B65B 21/06 198/430
2003/0019726 A1 * 1/2003 Hartness ..... B65G 47/5131 198/594
2003/0037514 A1 * 2/2003 Hartness ..... B65B 21/183 53/471
2004/0020163 A1 * 2/2004 De Cardenas ..... B65B 61/205 53/53
2005/0045242 A1 * 3/2005 Osborne ..... B65B 3/003 141/27
2005/0284537 A1 * 12/2005 Hartness ..... B65G 17/323 141/144
2005/0284731 A1 * 12/2005 Hartness ..... B67C 3/225 198/465.4
2006/0005896 A1 * 1/2006 Till ..... A61L 2/22 141/147
2009/0045033 A1 * 2/2009 Hausladen ..... B08B 9/205 198/377.01
2009/0312865 A1 * 12/2009 Bonnain ..... B65G 47/082 700/230
2010/0160376 A1 6/2010 Thompson
2011/0302884 A1 * 12/2011 Monti ..... B65B 3/003 53/281
2013/0067867 A1 * 3/2013 Veile ..... B65B 43/42 53/471
2014/0102580 A1 * 4/2014 Kass ..... B65B 3/04 141/9
2015/0114408 A1 * 4/2015 Lord ..... A24F 47/008 131/329
2015/0191266 A1 * 7/2015 Holmes ..... A24F 47/008 141/86
2015/0289565 A1 * 10/2015 Cadieux ..... A24F 47/002 131/328
2015/0291301 A1 * 10/2015 Cadieux ..... A24F 47/008 156/185
2017/0006921 A1 * 1/2017 Lemay ..... A24F 47/008
2017/0121169 A1 * 5/2017 Dailey ..... A24F 47/002
2017/0283102 A1 * 10/2017 Strauch ..... B65B 1/04
2018/0014999 A1 * 1/2018 Larimer ..... A61J 3/07
2018/0222607 A1 * 8/2018 Commandeur ..... B65B 51/32
2018/0229866 A1 * 8/2018 Eberhardt ..... B65B 39/12
2019/0152627 A1 * 5/2019 Ghiotti ..... B65B 1/06

FOREIGN PATENT DOCUMENTS

| | | | |
|---|---|---|---|
| DE | 10 2010 043 160 | A1 | 5/2012 |
| DE | 10 2011 082 709 | A1 | 3/2013 |
| DE | 10 2012 209 714 | A1 | 12/2013 |
| EP | 0621185 | A1 | 10/1994 |
| EP | 1 988 018 | A2 | 11/2008 |
| EP | 2570350 | A1 | 3/2013 |
| FR | 2354927 | A1 | 1/1978 |
| WO | WO-2007/115085 | A1 | 10/2007 |
| WO | WO-2013/093763 | A1 | 6/2013 |

* cited by examiner

MACHINE AND METHOD FOR PRODUCING ELECTRONIC-CIGARETTE CARTRIDGES

CROSS-REFERENCE TO RELATED APPLICATIONS

This is the U.S. national phase of International Application No. PCT/IB2015/052004, filed Mar. 20, 2015, which claims the benefit of Italian Patent Application No. BO2014A000147, filed Mar. 21, 2014.

TECHNICAL FIELD

The present invention relates to a machine and to a method for producing electronic-cigarette cartridges.

PRIOR ART

Recently electronic-cigarettes cartridges for single use (i.e. disposable) have been proposed inside which a hygroscopic pad is contained (such as a cotton pad) that is impregnated with a viscous liquid substance containing nicotine and possible flavourings. In use, the electronic-cigarette heats the cartridge thus causing the slow volatilization (vapourization) of the viscous liquid substance impregnating the hygroscopic pad.

The production of said cartridges envisages the production of cartridges with an open top end, the insertion of the dry hygroscopic pad into the cartridges, filling the cartridges with a calibrated amount of the liquid substance, and then plugging the cartridges by applying a cap permeable to vapours to the open top end (i.e. a cap that prevents the liquid substance from leaking, but that does not prevent the vapour generated by heating the liquid substance from escaping); once the cap is applied, a corresponding adhesive label is wound around each cartridge to end the production process.

Currently the production of the cartridges is performed manually or with rudimentary machines which provide a continuous use of labour; consequently, the production of the cartridges takes place in a slow manner (that is, with a low productivity) and with very variable and generally low quality.

The patent application DE102011082709A1 describes a machine 10 for producing containers for pharmaceutical liquids; the machine 10 comprises: a fill conveyor 12 which feeds the containers 1 along a fill path; a filling device 40 located along the fill path to feed a measure of a liquid substance downwards into each container 1 (a weighing device 42 independently for each container 2 is provided); an assembly conveyor 47 which feeds the containers 1 along an assembly path; a transfer station where the containers 1 are transferred from the fill conveyor 12 to the assembly conveyor 47; and an assembly device 43 located along the assembly path to fit each container 1 with a corresponding cap. Both the fill conveyor 12, and the assembly conveyor 47 feed a single container 1 at a time along the corresponding paths.

DESCRIPTION OF THE INVENTION

The object of the present invention is to provide a machine and a method for producing electronic-cigarette cartridges, which machine and method allow to reach high productivity and are, at the same time, easy and inexpensive to manufacture.

According to the present invention, a machine and a method for producing electronic-cigarette cartridges, as claimed in the appended claims, are provided.

BRIEF DESCRIPTION OF THE DRAWINGS

The present invention will now be described with reference to the accompanying drawings, which illustrate a non-limitative embodiment, wherein.

PREFERRED EMBODIMENTS OF THE INVENTION

Figure 1:
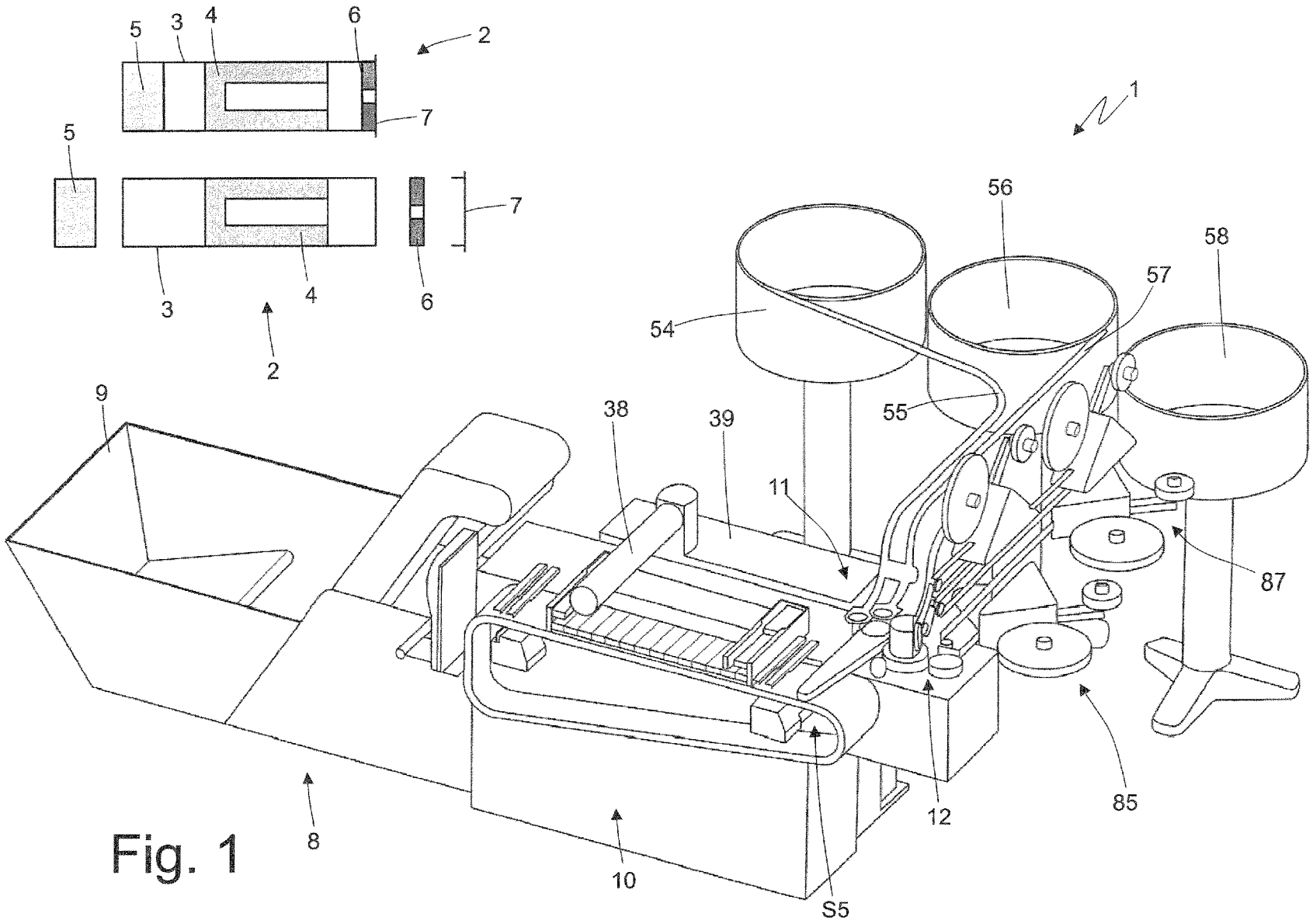
FIG. 1 is a schematic perspective view of a machine for producing electronic-cigarette cartridges made according to the present invention.
Figure 2:
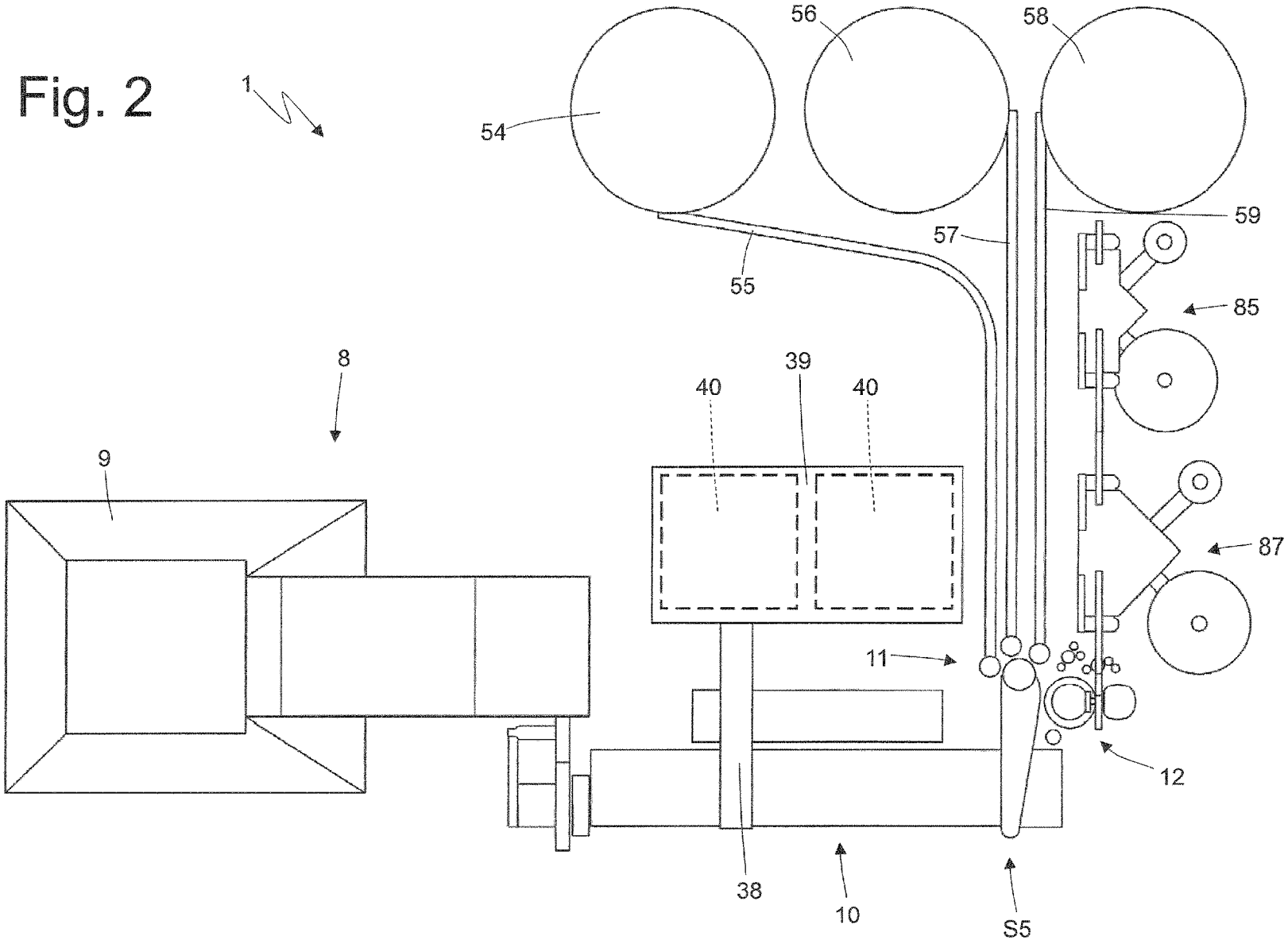
FIG. 2 is a plan schematic view of the machine of FIG. 1.

In FIGS. 1 and 2 number 1 indicates as a whole a machine for producing electronic-cigarette cartridges 2.

As shown in FIG. 1, each cartridge 2 comprises a cylindrical internally hollow bottom shell 3 inside which a hygroscopic pad 4 is arranged (for example a cotton pad) that is impregnated with a viscous liquid substance (for example propylene glycol) containing nicotine and possible flavourings; a bottom cap 5 is fitted to a bottom end of the cylindrical bottom shell 3, while a gasket 6 and a top cap 7 are fitted to a top end of the cylindrical bottom shell 3.

As illustrated in FIGS. 1 and 2, the machine 1 comprises a feed unit 8 which receives a mass of unordered bottom shells 3 (i.e. a mass of bottom shells 3 arranged in bulk) in a collecting tank 9 open at the top and manipulates the bottom shells 3 to arrange the bottom shells 3 in an ordered succession, a fill unit 10 which receives bottom shells 3 arranged by the feed unit 8 and fills the bottom shells 3 themselves with the liquid substance to impregnate the corresponding hygroscopic pads 4, an assembly unit 11 which receives the bottom shells 3 from the fill unit 10 and applies the corresponding bottom cap 5, the gasket 6 and the top cap 7 to each bottom shell 3, and a labelling unit 12 which receives the bottom shells 3 from the assembly unit 10 and applies a main label 13 (illustrated schematically in FIG. 18) and a sealing label 14 (shown schematically in FIG. 17) to each bottom shell 3.

Figure 19:
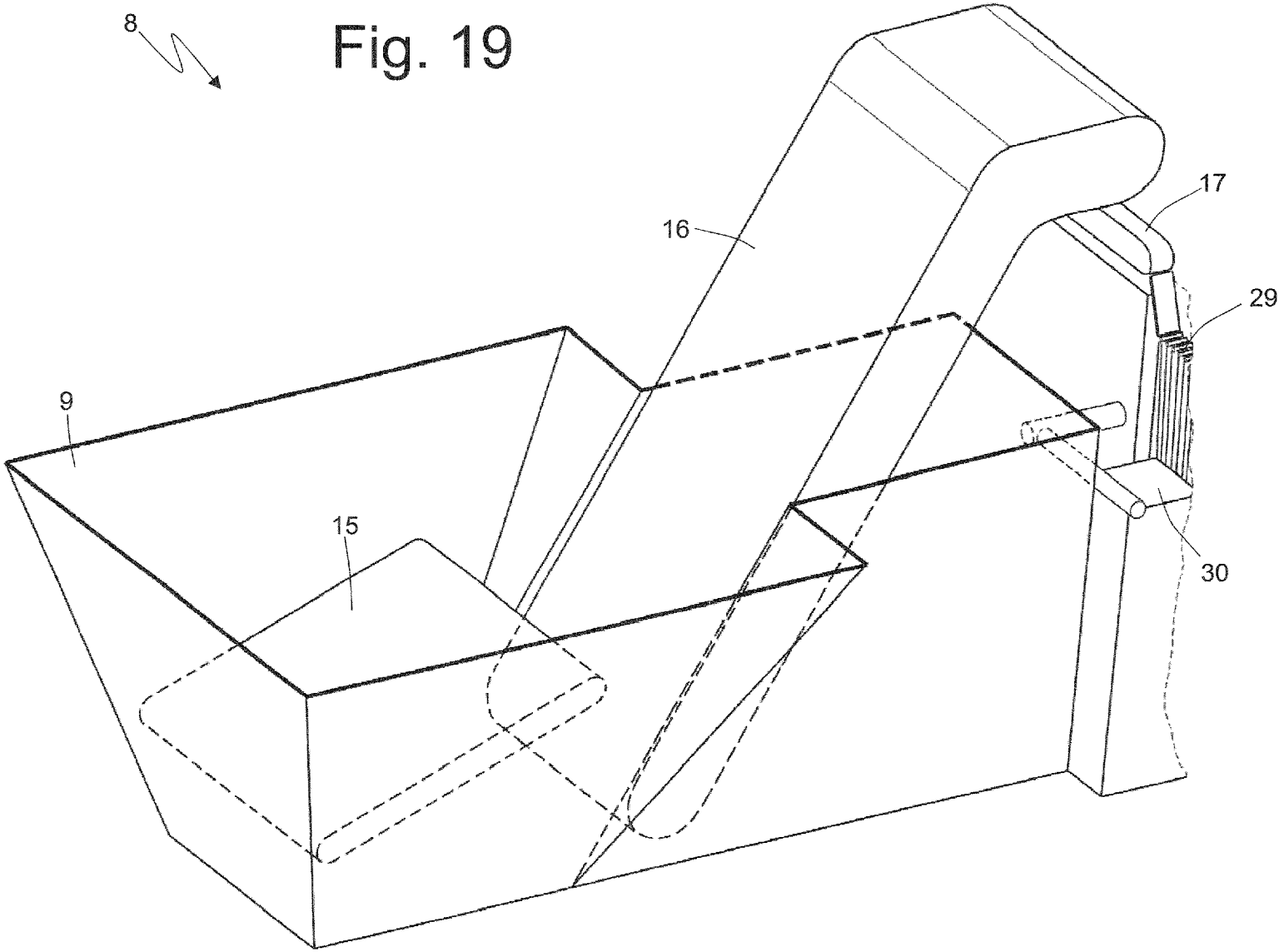
FIG. 19 is a schematic perspective view of the empty cartridges feed unit of the machine of FIG. 1.

As illustrated in FIG. 19, the feed unit 8 comprises a belt feed conveyor 15, which is located completely inside the collecting tank 9 at the bottom of the collecting tank 9 itself and is slightly inclined upwards so as to convey the bottom shells 3 from the bottom upwards along an inclined plane (i.e. an inlet end of the feed conveyor 15 is lower than an outlet end of the feed conveyor 15). In addition, the feed unit 8 comprises a belt feed conveyor 16, which is partially located inside the collecting tank 9 and is inclined upwards so as to convey the bottom shells 3 from the bottom upwards along an inclined plane (i.e. an inlet end of the feed conveyor 16 is arranged lower than an outlet end of the feed conveyor 16). In particular, the feed conveyor 16 is located immediately downstream from the feed conveyor 15 so that bottom shells 3 in front of the feed conveyor 15 are directly transferred to the feed conveyor 16; to this purpose, the inlet end of the feed conveyor 16 is located below the outlet end of the feed conveyor 15. Finally, the feed unit 8 comprises a belt feed conveyor 17, which is arranged horizontally and is oriented transversely with respect to the feed conveyor 16 (i.e. the feed direction of the bottom shells along the feed conveyor 17 is transverse to the feed direction of the bottom shells 3 along the feed conveyor 16). In particular, the feed conveyor 17, is located immediately downstream from the feed conveyor 16 so that bottom shells 3 in front of the feed conveyor 16 are directly transferred to the feed conveyor 17; for this purpose, an inlet end of the feed conveyor 17 is located below the outlet end of the feed conveyor 16.

Figure 22:
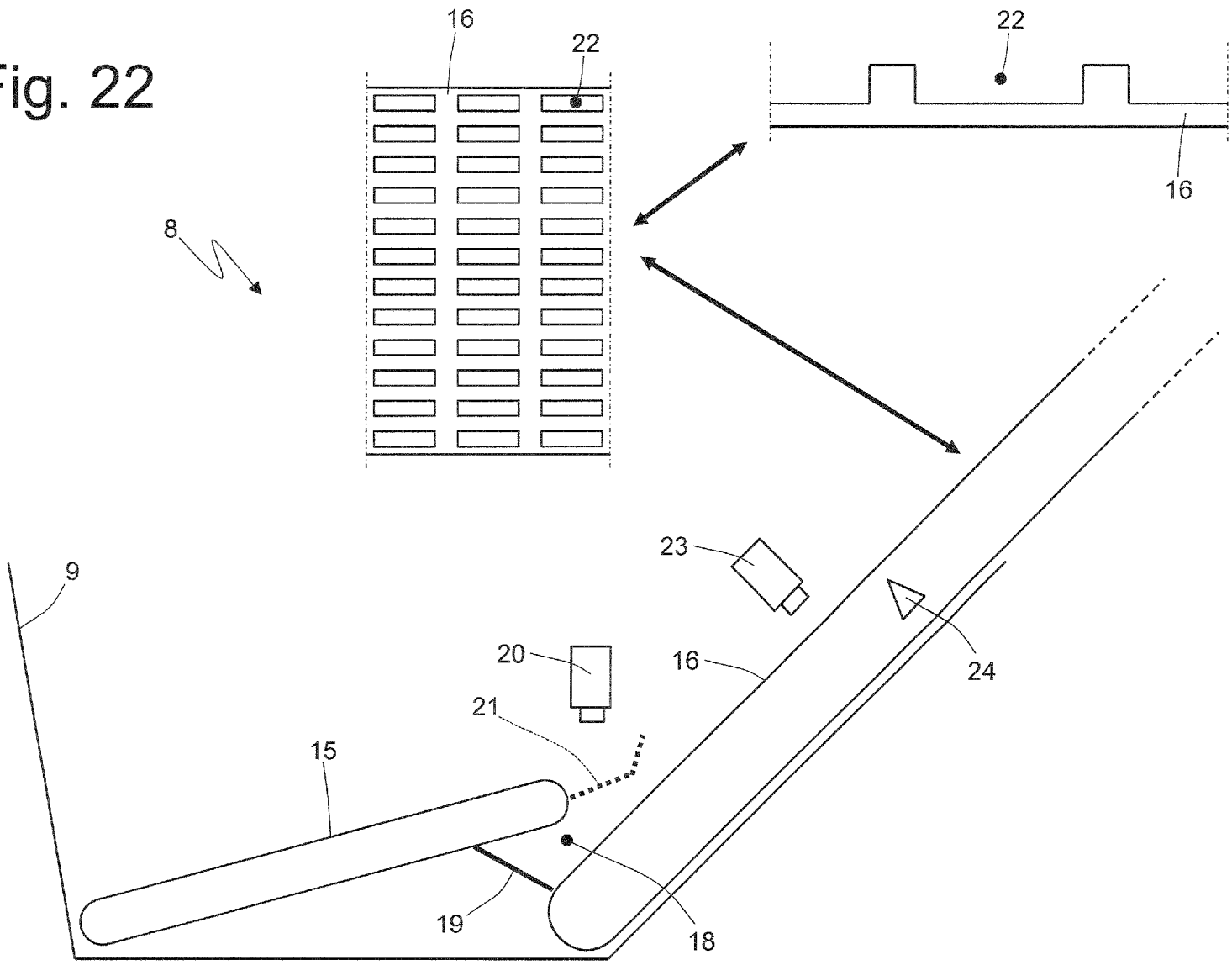
FIG. 22 is a schematic side section of an initial part of the feed unit of FIG. 19.

As illustrated in FIG. 22, between the outlet end of the feed conveyor 15 and the inlet end of the feed conveyor 16 an accumulation area 18 is defined, in which the bottom shells 3 coming from the feed conveyor 15 are accumulated; from the accumulation area 18 the bottom shells 3 are subsequently withdrawn by the feed conveyor 16. The accumulation area 18 is delimited at the back by a fixed bottom wall 19 located between the feed conveyors 15 and 16. It is important to note that the size of the accumulation area 18 are reduced so as to limit the amount of bottom shells 3 that are collected in the accumulation area 18, and then so as to limit the mechanical stress to which the bottom shells 3 are subjected in the accumulation area 18 itself.

According to a preferred embodiment illustrated in FIG. 22, the number of bottom shells 3 in the accumulation area 18 is detected by a sensor 20 (for example by optically measuring the height of the group of bottom shells 3 in the accumulation area 18) and then the feed conveyor 15 is actuated to keep the number of bottom shells 3 in the accumulation area 18 within a desired and predetermined range; in other words, when there is a large number of bottom shells 3 in the accumulation area 18 the feed conveyor 15 is slowed down (even up to the stop), while when there is a reduced number of bottom shells 3 in the accumulation area 18 the feed conveyor 15 is accelerated (possibly re-starting it if previously stopped).

According to a preferred embodiment illustrated in FIG. 22, between the trailing end of the feed conveyor 15 and the leading end of the feed conveyor 16 an orienting grid 21 is arranged, which has the function of guiding in a longitudinal direction the bottom shells 3 that from the feed conveyor 15 are passed to the feed conveyor 16, i.e. to orient in the longitudinal direction the bottom shells 3 that are deposited in the accumulation area 18. The bottom shells 3 have a completely random arrangement on the feed conveyor 15 while it would be desirable for the bottom shells 3 to show a longitudinal orientation in the feed conveyor 16 (according to which the central axis of symmetry of the cylindrical bottom shell 3 is parallel to the feed direction of the feed conveyor 16); to facilitate the longitudinal orientation of the bottom shells in the feed conveyor 16 a rake-shaped orienting grid 21 is used to allow only the longitudinally oriented bottom shells 3 to pass through the orienting grid 21 itself to reach the accumulation area 18.

According to a preferred embodiment illustrated in FIG. 22, the feed conveyor 16 is provided with pockets 22, each of which is adapted to contain a corresponding longitudinally oriented bottom shell 3; in other words, the belt of the feed conveyor 16 has a number of pockets 22 adapted to contain respective longitudinally oriented bottom shells 3. To be fed along the feed conveyor 16 a bottom shell 3 must necessarily be inserted into a corresponding pocket 22, since the high slope of the feed conveyor 16 prevents a bottom shell 3 from climbing back along the feed conveyor 16 if not inserted inside a corresponding pocket 22; in this way it is ensured that the bottom shells 3 are fed by the feed conveyor 16 towards the feed conveyor 17 only if they have the desired longitudinal orientation (i.e. only if inserted in corresponding longitudinally oriented pockets 22).

According to a preferred embodiment illustrated in FIG. 22, an optical control device 23 is provided located along the feed conveyor 16 and is adapted to determine the orientation of the bottom shells 3 inside the pockets 22 of the feed conveyor 16 itself; in other words, the optical control device 23 checks whether the bottom shells 3 inside the pockets 22 of feed conveyor 16 have or do not have the desired orientation. Furthermore an ejecting device 24 is provided located along the feed conveyor 16 downstream from the optical control device 23 and adapted to eject from the corresponding pocket 22 of the feed conveyor 16 each bottom shell 3 having a wrong orientation (i.e. different from the right orientation); by way of example, the ejecting device 24 is of pneumatic type and ejects a bottom shell 3 from the corresponding pocket 22 of the feed conveyor 16 by means of a discharge of compressed air directed perpendicularly to the feed conveyor 16. A bottom shell 3 that is ejected from the corresponding pocket 22 of the feed conveyor 16 by the action of the ejecting device 24 lowers by gravity along the feed conveyor 16 until returning to the accumulation area 18.

According to a preferred embodiment illustrated in FIG. 22, the feed conveyor 16 feeds a row of bottom shells 3 which is formed by a number of bottom shells 3 aligned perpendicular to a feed path so as to feed along the feed path itself many bottom shells 3 at a time; in this way, the feed conveyor 16 is able to have a high productivity per hour (i.e. the number of bottom shells 3 feed per unit of time) while presenting a feed rate relatively modest. It is important to note that it is essential for the feed conveyor 16 to have a relatively modest feed rate, because only if the feed conveyor 16 has a relatively modest feed rate then the bottom shells 3 can be inserted at a high rate inside the pockets 22 of the feed conveyor 16 at the accumulation area 18 (i.e. at the inlet end of the feed conveyor 16). Furthermore, it is important to specify that the nominal hourly productivity of the feed conveyor 16 must be adequately greater than the nominal hourly productivity of the machine 1, as not all the pockets 22 of the feed conveyor 16 are always properly filled by corresponding bottom shells 3 at the accumulation area 18 (i.e. at the inlet end of the feed conveyor 16); in other words, the feed conveyor 16 will never be able to operate with its nominal hourly productivity because not all of the pockets of the feed conveyor 16 are always properly filled by corresponding bottom shells 3 at the accumulation area 18 and thus the nominal hourly productivity of the feed conveyor 16 must be appropriately greater than the nominal hourly productivity of the machine 1.

Figure 3:
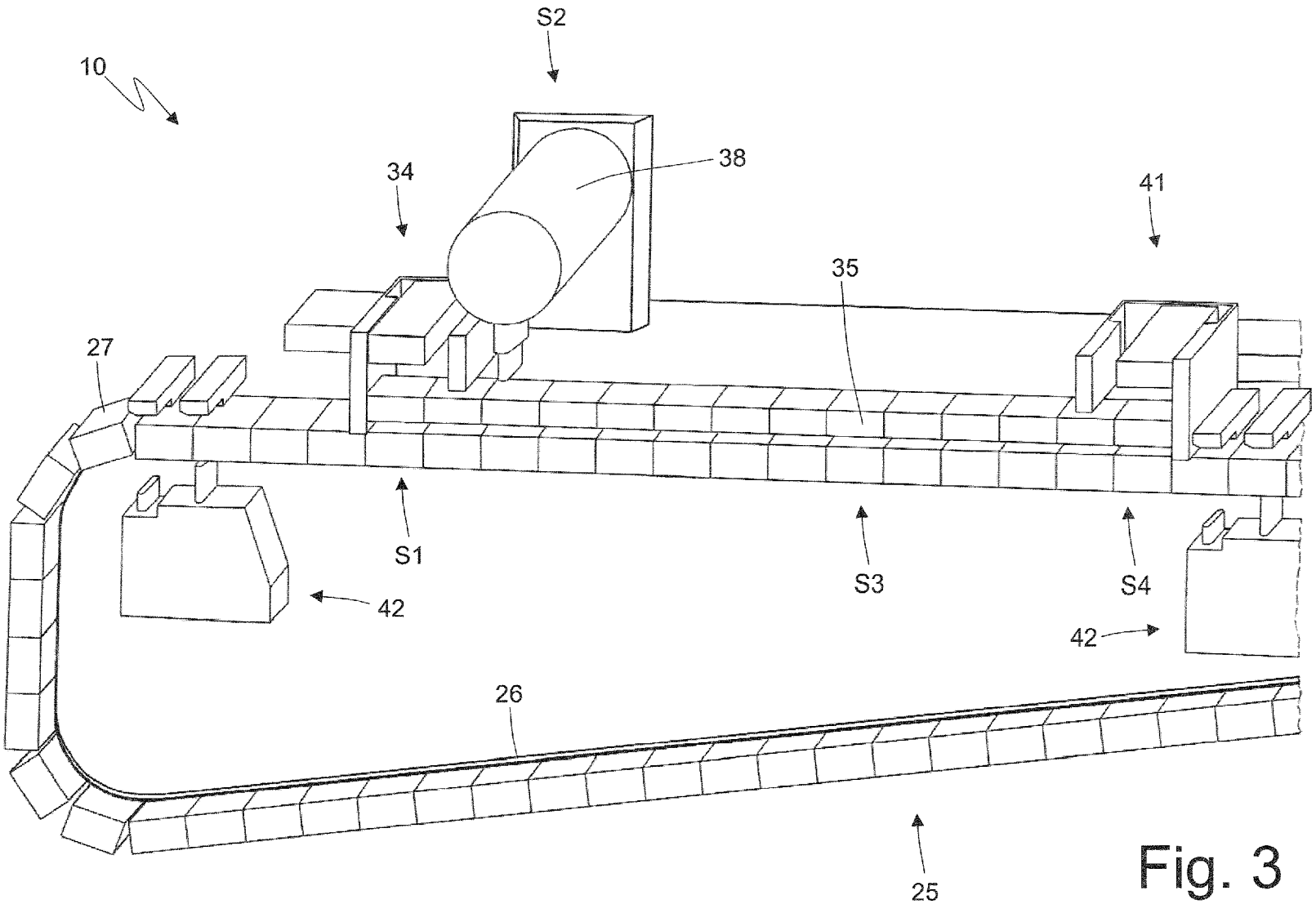
FIG. 3 is a schematic perspective view of a fill unit of the machine of FIG. 1.
Figure 4:
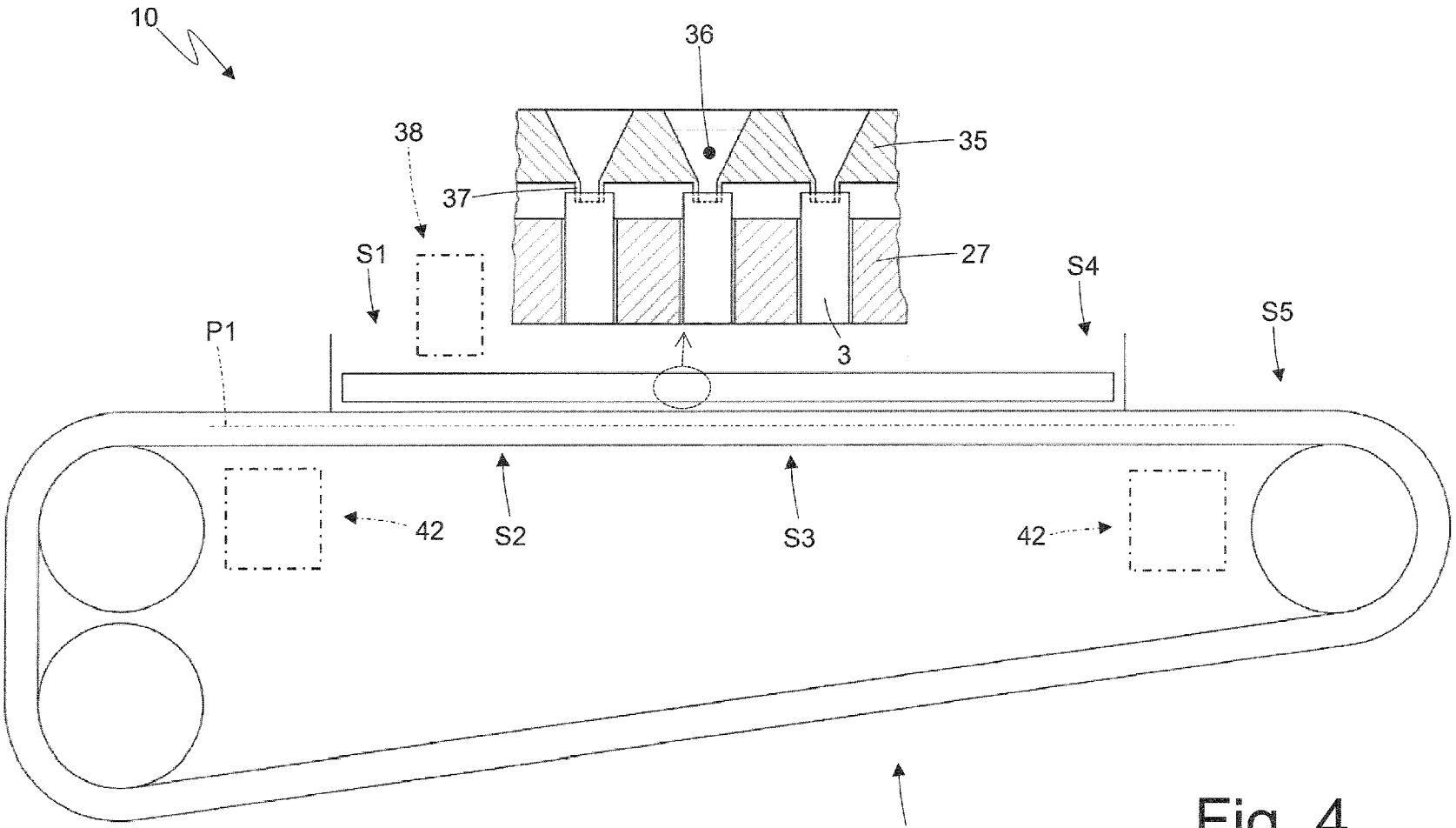
FIG. 4 is a schematic and front view of the fill unit of FIG. 3.
Figure 5:
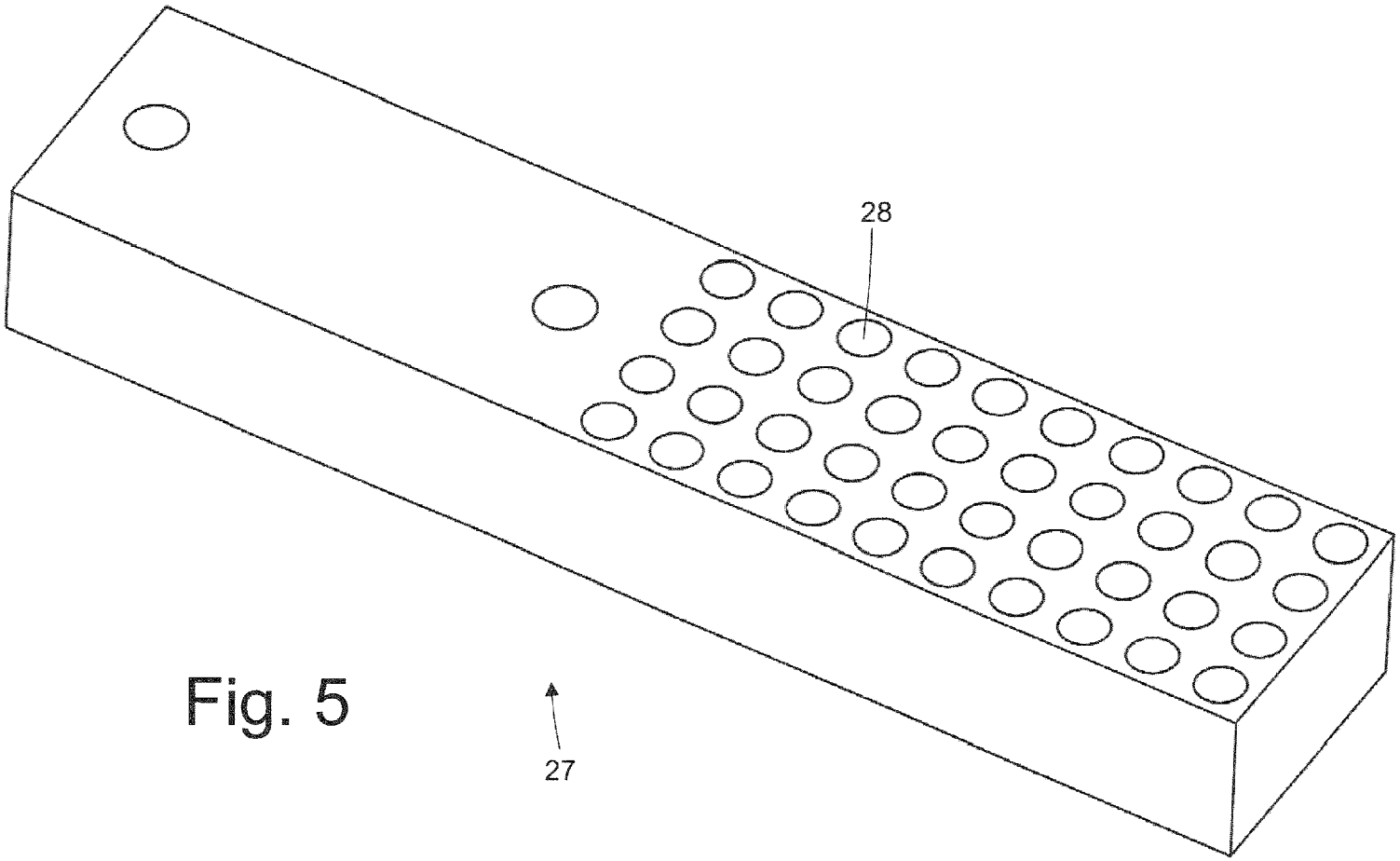
FIG. 5 is a schematic perspective view of a fill conveyor cartridge-holder of the fill unit of FIG. 3.

As shown in FIG. 4, the fill unit 10 comprises a fill conveyor 25 which feeds the bottom shells 3 along a straight fill path P1 and arranged horizontally with an intermittent motion i.e. a motion that provides a cyclic alternation of motion steps, in which the fill conveyor 25 is in motion, and rest steps, in which the fill conveyor 25 is stopped. In the embodiment illustrated in FIG. 3, the fill conveyor 25 is a belt conveyor having a flexible belt 26 which is wound ring-like around respective pulleys (known and not illustrated) and supports a number of cartridge-holders 27 arranged side by side one to the other; each cartridge-holder 27 is cantilevered fixed to the flexible belt 26. As shown in FIG. 5, each cartridge-holder 27 has a number of cylindrical seats 28, each of which is adapted to receive and house a corresponding bottom shell 3. In other words, the fill conveyor 25 feeds along the fill path P1 a succession of cartridge-holders 27, each of which houses inside an ordered assembly of bottom shells 3 which are arranged in several rows oriented perpendicularly to the fill path P1; in particular, each row consists of ten bottom shells 3 and one said cartridge-holder 27 supports four rows (i.e. a total of forty bottom shells 3). In this way, the filling operations of each row of the bottom shells 3 carried by the same cartridge-holder 27 are performed in parallel, i.e. occur simultaneously for all the bottom shells 3.

Figure 20:
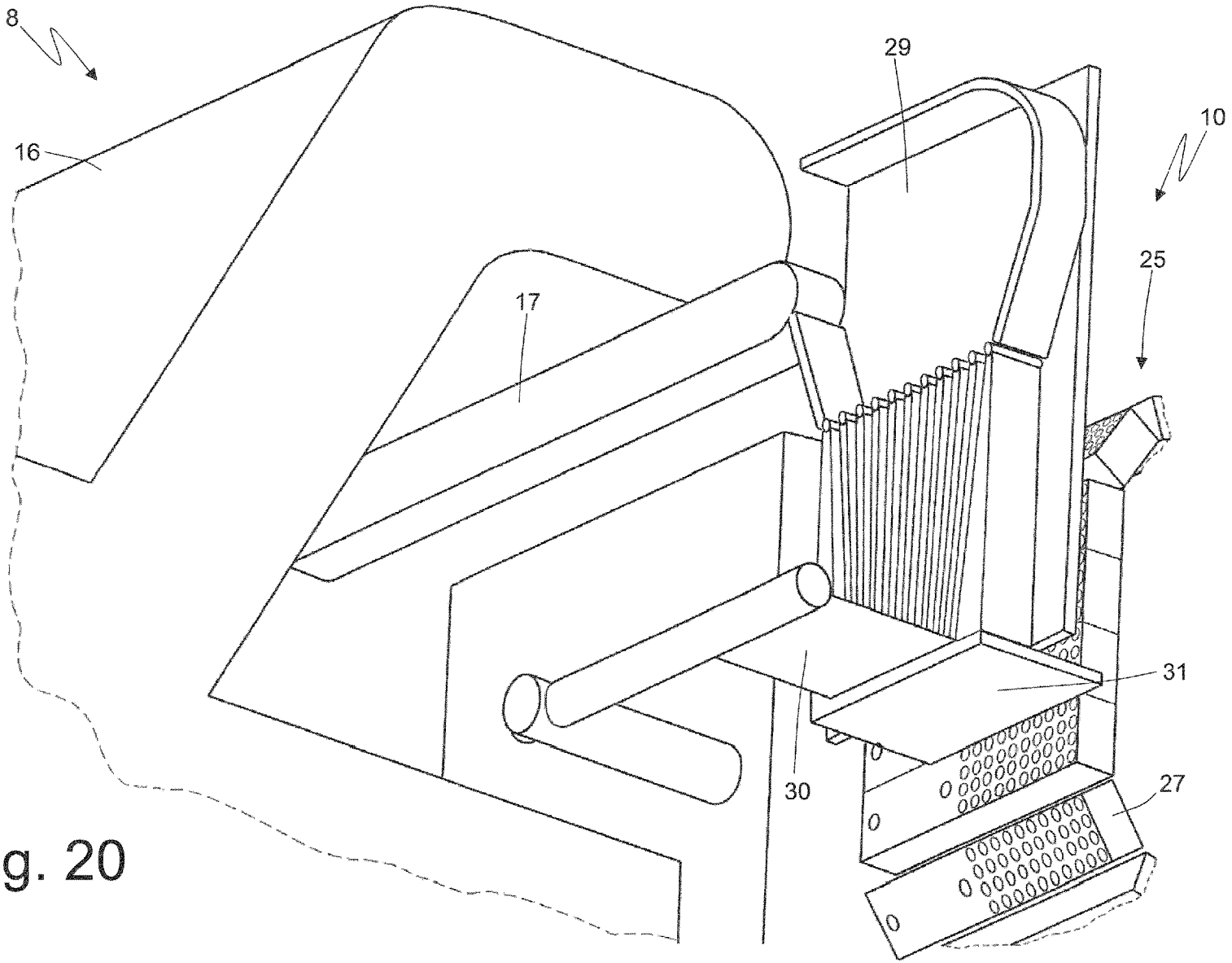
FIG. 20 is a schematic view, in perspective and on an enlarged scale of a detail of the feed unit of FIG. 19.
Figure 21:
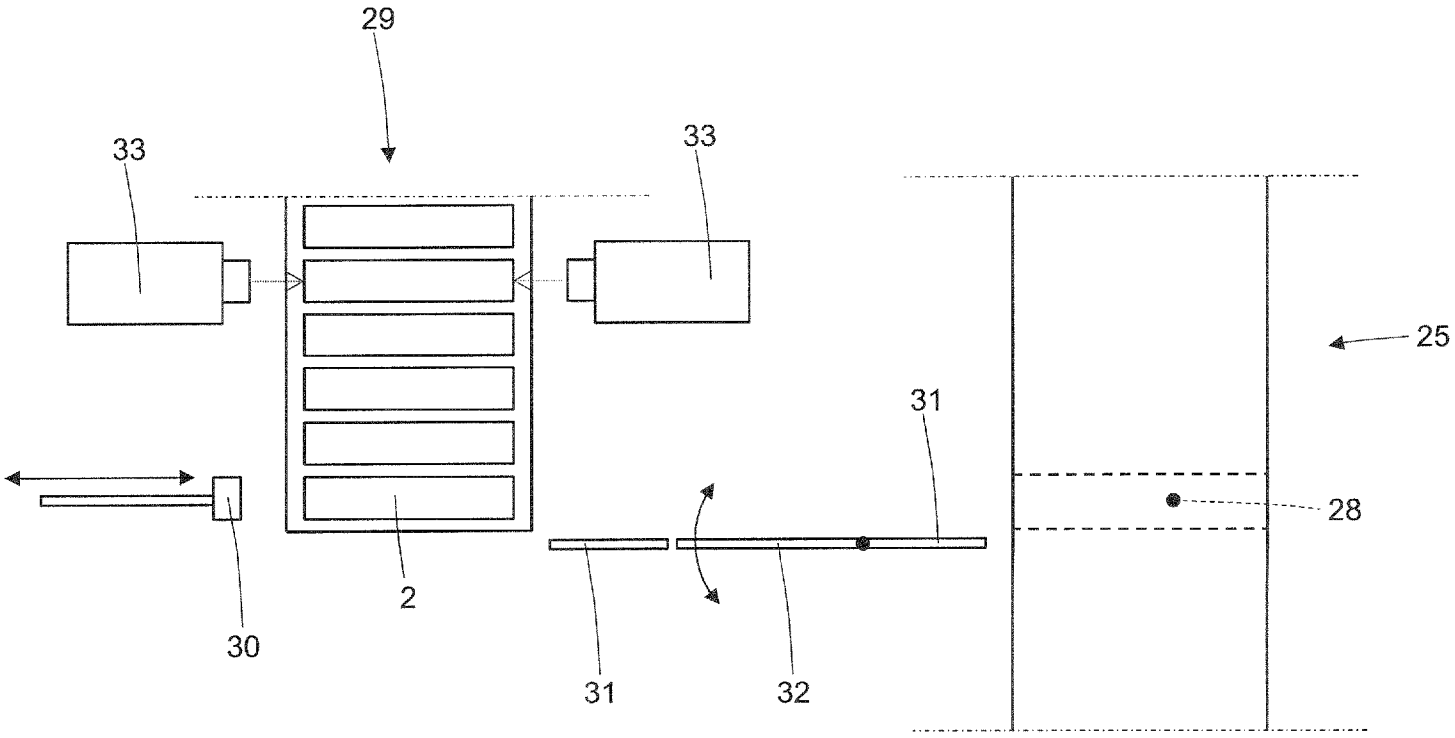
FIG. 21 is a schematic sectional side view of a hopper of the feed unit of FIG. 19.

As illustrated in FIGS. 20 and 21, the fill unit 10 comprises a hopper 29 located alongside a vertical portion of the fill conveyor 25 and has in the bottom portion a number of vertical channels, each for receiving and conveying a corresponding vertical row of bottom shells 3. To the hopper a pusher 30 is coupled which is movable horizontally through the vertical channels of the hopper 29 to push a row of bottom shells 3 out of the vertical channels and then inside the fill conveyor 25 (in particular in corresponding seats 28 of a cartridge-holder 27 carried by the fill conveyor 25). A chute 31 is provided which is arranged horizontally between the hopper 29 and the fill conveyor 25 and whereon the bottom shells 3 are flowing when pushed by the pusher 30 towards the fill conveyor 25.

According to a preferred embodiment, the chute 31 has a number of controllable hatches 32 (only one of which is shown schematically in FIG. 21) that are formed through the chute and each of which is individually openable to allow the discharge of a corresponding bottom shell 3 by deflecting the bottom shell 3 itself towards a discharge path (typically located below the chute 31 and then along which the discarded bottom shell 3 falls by gravity); in other words, when a bottom shell 3 to be discarded is found (for the presence of defects in materials), the discharge occurs during the travelling of the chute 31 by opening the corresponding hatch 32 which by opening deflects the bottom shell 3 towards the discharge path (and thus the defective bottom shell 3 does not enter the fill conveyor 25). According to a preferred embodiment, to check the presence of defects in the bottom shells 3 a control station is provided, which is located at the hopper 29 and comprises at least one optical control device 33 (for example a CCD camera), which "looks" towards the vertical channels of the hopper 29 to observe the bottom shells 3. The discharge of the deformed bottom shells 3 (i.e. presenting defects that alter the shape of the bottom shells 3) before entering the bottom shells 3 in the seats 28 of the cartridge-holders 27 of the fill conveyor 25 is very important, as a deformed bottom shell 3 may get stuck (i.e. wedged by interference) completely or partially inside a seat 28 without any possibility to be extracted if not by stopping the machine 1 and thus requiring the manual intervention of an operator.

Figure 6:
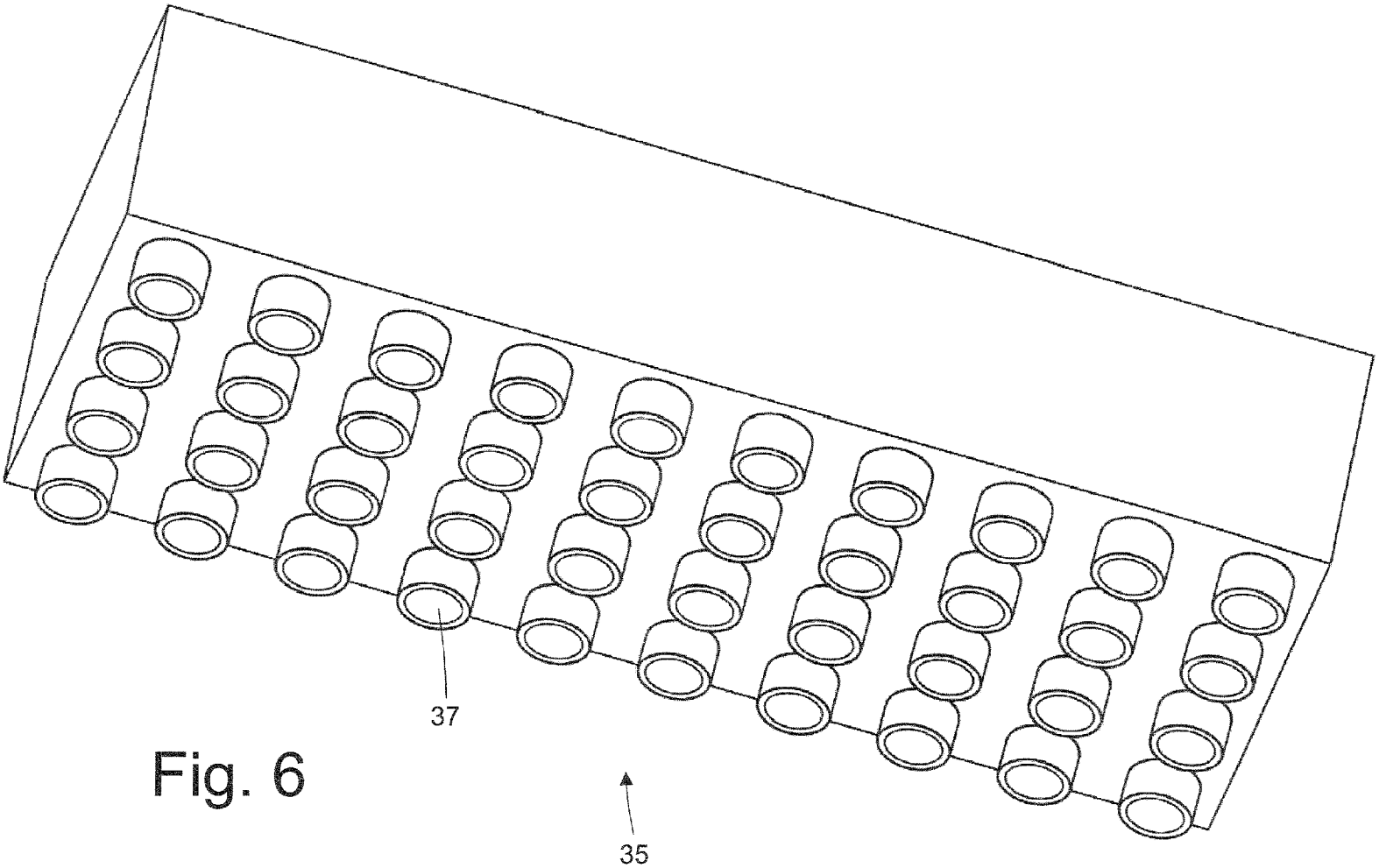
FIG. 6 is a schematic perspective view of a fill unit measuring element of the fill conveyor of FIG. 3.

As illustrated in FIGS. 3 and 4, along a straight horizontal section of the fill conveyor 25 and at the start of the fill path P1, a coupling station is arranged in which a coupling device 34 (shown only in FIG. 3) couples each cartridge-holder 27 of the fill conveyor 25 with a corresponding measuring element 35 (best shown in FIG. 6); normally, each measuring element 35 is simply placed on top of the cartridge-holder 27.

As illustrated in FIG. 4, each measuring element 35 comprises a number of measuring chambers 36, each of which is arranged above a corresponding bottom shell 3, has a volume sufficient to contain the entire measure of liquid substance (i.e. the entire amount of liquid substance which is to be fed inside of the bottom shell 3), and has at the bottom an outlet duct 37 which flows into the bottom shell 3. In other words, each measuring element 35 has a number of measuring chambers 36 which are arranged in a row oriented perpendicular to the fill path P1 so as to reproduce the arrangement of the bottom shells 3 in the cartridge-holders 27 and therefore so that to each bottom shell 3 housed in a cartridge 27 corresponds a measuring chamber 36.

Downstream from the coupling station S1 and along the fill path P1 a feed station S2 is arranged in which a filling device 38 is housed that feeds the liquid substance inside each bottom shell 3 by means of the corresponding measuring chamber 36. In other words, in the feed station S2 the filling device 38 feeds the liquid substance in each measuring chamber 36 so that from the measuring chamber 36 the liquid substance 3 descends by gravity into the bottom shell 3 through the outlet duct 37. As illustrated in FIGS. 1 and 2, the liquid substance is fed to the filling device 38 from a feed station 39, which is located behind the measuring conveyor 25 and supports two removable containers 40 (i.e. easily and completely replaceable) containing the liquid substance; preferably, each container 40 (which is completely replaceable) integrates, in its inside, both a feed pump for the extraction of the liquid substance, and agitators which in use are continuously mixing the liquid substance to prevent stratification thereof.

As illustrated in FIGS. 3 and 4, downstream from the feed station S2 and along the fill path P1 a number of standby stations S3 are arranged in succession; the cartridge-holders 27 containing the bottom shells 3, in which the liquid substance is flowing by gravity from the overlying measuring chambers 36 cross the standby stations S3 waiting that all the liquid substance has descended by gravity from each measuring chamber 36 to the underlying bottom shell 3 through the outlet duct 37.

At the end of the standby stations S3, i.e. downstream from the standby stations S3, and along the fill path P1 a removing station S4 is provided in which a removing device 41 (shown only in FIG. 3) removes the corresponding measuring element 35 from each cartridge-holder 27 once all the liquid substance has descended by gravity from each measuring chamber 36 to the underlying bottom shell 3 through the outlet duct 37.

It is important to note that the stations S1-S4 and the filling device 38 are located along a straight horizontal portion of the fill path P1 so as to allow the liquid substance to descend by gravity inside each bottom shell 3.

For a more detailed description of the construction and operation details of the fill unit 10 regarding the feeding of the liquid substance reference is made to what is described in the patent application BO2013A000504.

According to a preferred embodiment illustrated in FIGS. 3 and 4, at the start and at the end of the fill path P1 (i.e. upstream and downstream from the area in which the filling of the bottom shells 3 with the liquid substance occurs), two twin weighing devices 42 are provided, each for weighing each bottom shell 3; by weighing each bottom shell 3 before and after filling the bottom shell 3 with a liquid substance the amount of liquid substance that was actually erogated inside the bottom shell 3 can be accurately measured and therefore it can be verified whether the filling of the bottom shell 3 was performed correctly. According to a preferred embodiment, each weighing device 42 operates in parallel, i.e. weighs simultaneously all bottom shells 3 of the same row of bottom shells 3 contained in a corresponding cartridge-holder 27.

Figure 7:
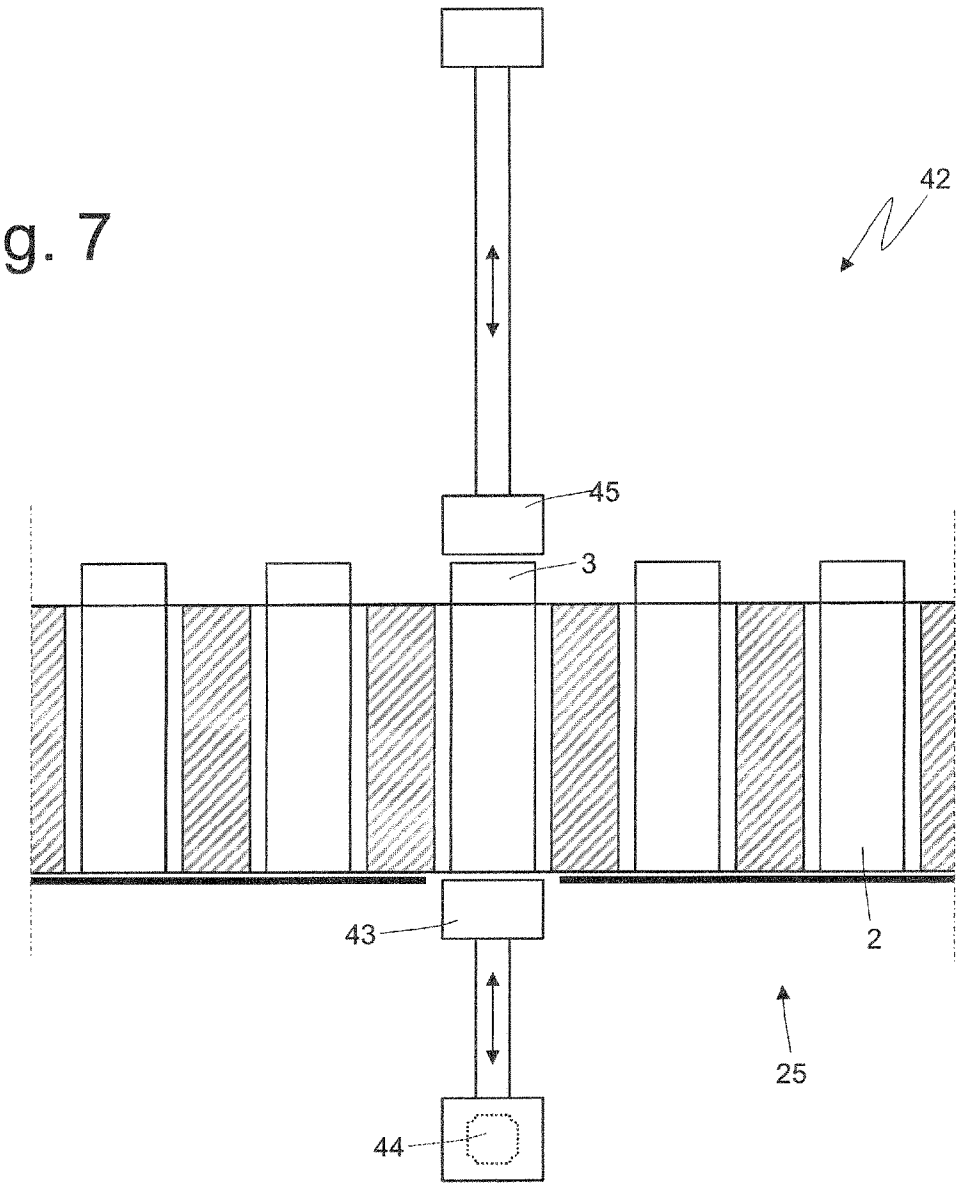
FIGS. 7, 8 and 9 are three schematic views showing in three different operational steps a weighing device of the fill unit of FIG. 3.
Figure 8:
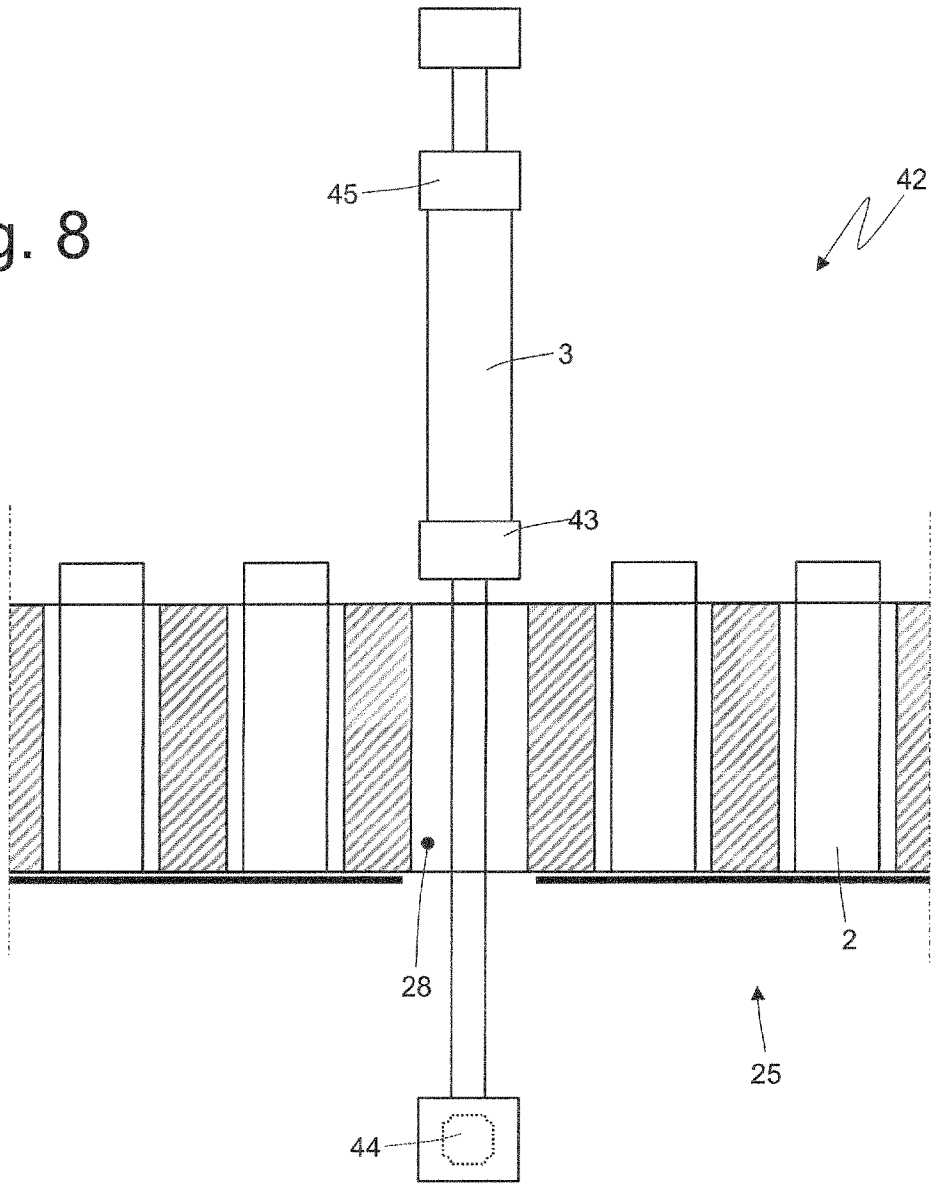
Figure 9:
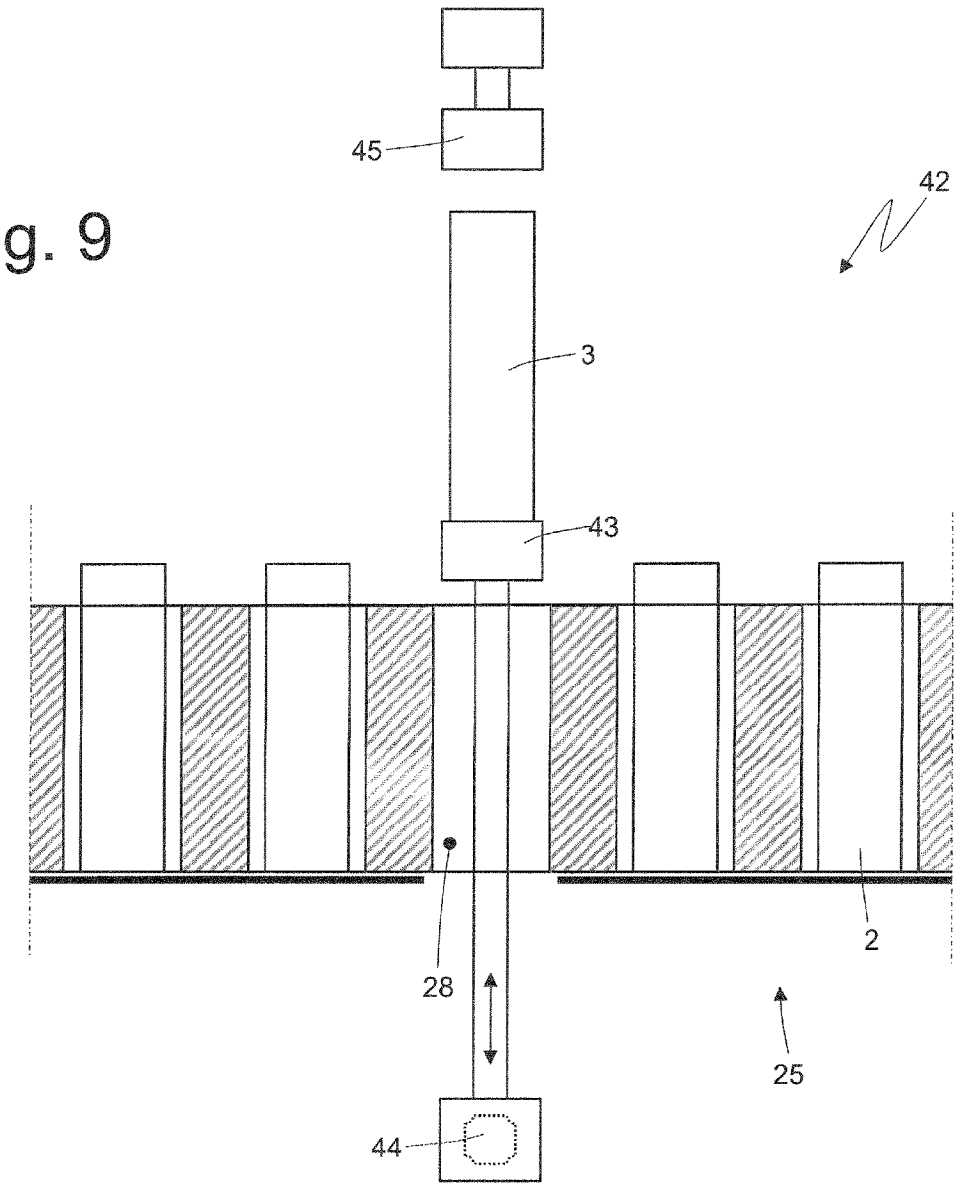

As illustrated in FIGS. 7, 8 and 9, each weighing device 42 comprises a number of pushers 43 (only one of which is shown for simplicity in FIGS. 7, 8 and 9), each of which is located below the fill conveyor 25 and is movable vertically to enter from the bottom of a corresponding seat 28 and then push a corresponding bottom shell 3 upwards until fully ejecting the bottom shell 3 from the seat 28 (as shown in FIGS. 8 and 9). Once a pusher 43 has ejected a bottom shell 3 from the corresponding seat 28 (i.e. when the bottom shell 3 does not touch the walls of the seat 28), the pusher 43 stops its stroke and then a weight sensor 44 (for example a load cell) integrated in the pusher 43 detects the weight of the bottom shell 3. At the end of weighing, each bottom shell 3 is again re-inserted in the corresponding seat 28 by means of a lowering movement opposite to the previous lifting movement. According to a preferred embodiment, each weighing device 42 operates in parallel, i.e. weighs simultaneously all bottom shells 3 of the same row of bottom shells 3 carried by a cartridge-holder 25.

According to a preferred embodiment, each pusher 43 is associated with a corresponding counter-pusher 45 (or contrast 45) which is arranged on the opposite side of the pusher 43 (i.e. located above the fill conveyor 25) and engages a top wall of the corresponding bottom shell 3 during the lifting of the bottom shell 3 (i.e. during ejection of the bottom shell 3 from the corresponding seat 28) and during the subsequent lowering of the bottom shell 3 (i.e. during the subsequent re-insertion of the bottom shell 3 in the corresponding seat 28) to accompany the movement of the bottom shell 3 itself. In other words, during the lifting and the subsequent lowering each bottom shell 3 is "pinched" at the bottom and at the top by the corresponding pusher 43 and counter-pusher 45 to be always stably and firmly driven, and therefore to prevent unwanted movement of the bottom shell 3 itself. It is important to note that at the time of weighing (and only at the time of weighing) of each bottom shell 3, the corresponding counter-pusher 45 is detached from the bottom shell 3 itself (as illustrated in FIG. 9) to avoid influencing the weight measurement.

The assembly of pushers 43 and of the corresponding counter-pushers 45 forms a lifting device, which is adapted to lift each bottom shell 3 thus vertically ejecting the bottom shell itself from the corresponding seat 28 of the cartridge-holder 27 and which is connected mechanically with the weight sensor 44 that detects the total weight of each bottom shell 3 when the bottom shell 3 itself is fully ejected from the corresponding seat 28. Each pusher 43 is located below the fill conveyor 25, is vertically movable for resting on a lower wall of a corresponding bottom shell 3, and is connected mechanically to a corresponding weight sensor 44; each counter-pusher 45 is located above the fill conveyor 25, is vertically movable for resting on an upper wall of a corresponding bottom shell 3 from the opposite side with respect to the corresponding pusher 43, and is adapted to be separated temporarily from the upper wall itself during the measuring of the weight of the bottom shell 3.

To allow the ejection of the vertical bottom shells 3, each cartridge-holder 27 has a bottom wall provided with a through hole at each seat 28; in this manner, each pusher 43 can enter from below inside the corresponding seat 28 to push vertically the bottom shell 3 outside the seat 28 itself. According to equivalent embodiments, each through hole of the bottom wall of a cartridge-holder can be as large as the seat 28 (i.e. may have the same diameter of the seat 28 and in this case below the fill conveyor 25 a fixed plate is arranged), or can be smaller than the seat 28 (i.e. may have a diameter smaller than the diameter of the seat 28).

According to a preferred embodiment, the weighing device 42 located upstream from the filling device 35 also comprises additional control sensors which are adapted to check the correct operation of the electric circuit located inside each bottom shell 3 (for example to determine whether the electrical circuit has electrical continuity i.e. is not electrically interrupted in an abnormal manner); for example, the electrodes of the control sensors could be integrated into the heads of the pusher 43 which comes into contact with the bottom wall of each bottom shell 3. In this manner, before, during or after weighing each bottom shell 3, the weighing device 42 determines also the proper functioning of the electric circuit located inside each bottom shell 3. It is important to note that if before the filling process a bottom shell 3 with a problem in the electric circuit is detected (i.e. a defective bottom shell 3 to be discarded) then feeding the liquid substance inside said bottom shell 3 is avoided.

Figure 10:
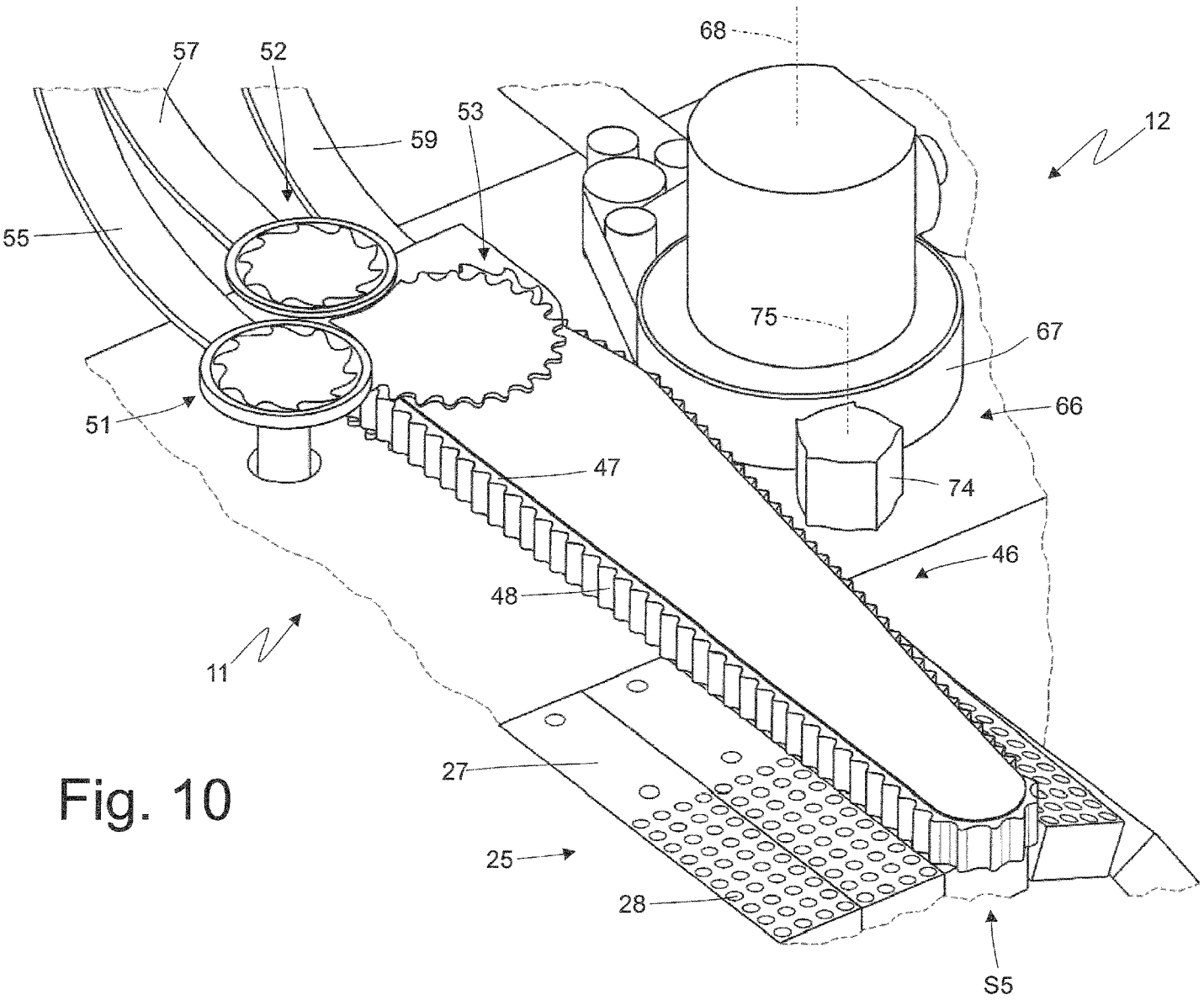
FIG. 10 is a schematic perspective view of an assembly unit and part of a labelling unit of the machine of FIG. 1.

As illustrated in FIG. 10, the drive assembly 11 comprises a belt assembly conveyor 46 which feeds bottom shells 3 along an assembly path P2 (illustrated in FIG. 11) with an intermittent motion, i.e. with a motion that provides a cyclic alternation of motion steps, in which the assembly conveyor 46 is in motion, and rest steps, in which the assembly conveyor is stopped. In particular, the assembly conveyor 46 comprises a belt conveyor which is arranged vertically (i.e. is oriented vertically) and supports a number of seats 48, each of which adapted to contain and hold a corresponding bottom shell 3 embracing the cylindrical side wall of the bottom shell 3 itself; according to a preferred embodiment, the seats 48 of the assembly conveyor 46 have a certain elastic deformability, and therefore the bottom shells 3 are held inside the seats 48 "fitting" the bottom shells 3 inside the seats 48 themselves. According to a preferred embodiment, the belt 47 of the assembly conveyor 46 is wound ring-like around two end pulleys (known and not illustrated) having different diameters and arranged horizontally (i.e. rotatable about respective vertical axes of rotation).

Figure 12:
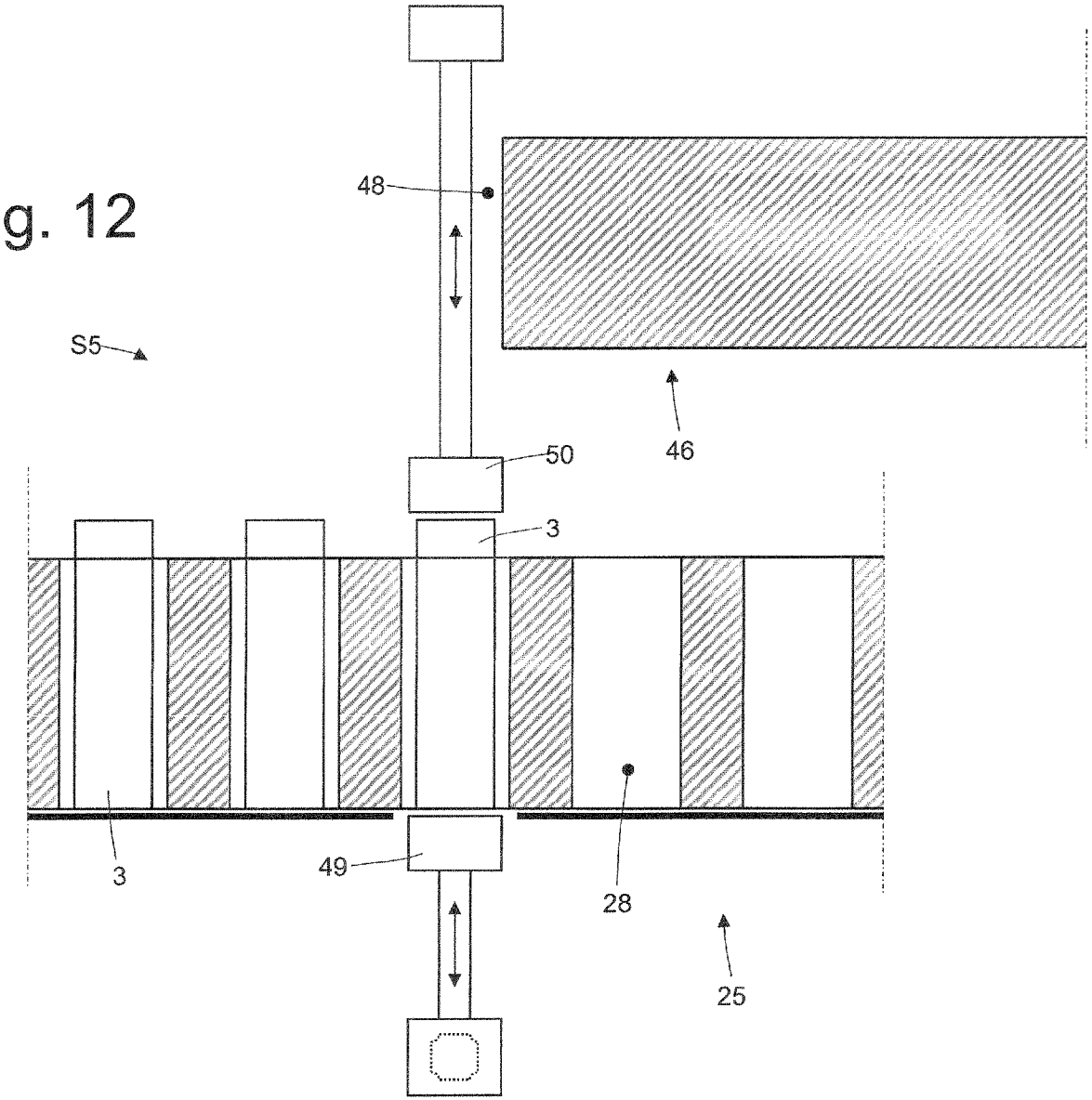
FIG. 12 is a schematic view of a transfer station between a fill conveyor of the fill unit of FIG. 3 and an assembly conveyor of the assembly unit of FIG. 10.

One end of the assembly conveyor 46 is located above a straight horizontal portion of the fill path P1 (i.e. above a horizontal straight portion of the fill conveyor 25) at a transfer station S5 where the bottom shells 3 are transferred from the fill conveyor 25 to the assembly conveyor 46. As illustrated in FIG. 12, the transfer station S5 comprises a lifting device, which is entirely analogous to the lifting devices of the weighing devices 42 and is adapted for vertically lifting each bottom shell 3 to transfer the bottom shell 3 itself from the fill conveyor 25 to the overlying assembly conveyor 46 (i.e. from a seat 28 of a cartridge-holder 27 of the fill conveyor 25 to an overlying seat 48 of the assembly conveyor 46). The lifting device of the transfer station S5 comprises a number of pushers 49 (only one of which is shown for simplicity in FIG. 12), each of which is located below the fill conveyor 25 and is movable vertically to enter from the bottom of a corresponding seat 28 and then push upwards a corresponding bottom shell 3 until ejecting the bottom shell 3 from the seat 28 and then insert the bottom shell 3 in a corresponding seat 48 of the assembly conveyor 46. According to a preferred embodiment, the lifting device of the transfer station S5 operates in parallel i.e. simultaneously transfers all bottom shells 3 of the same row of bottom shells 3 carried by a cartridge-holder 25.

According to a preferred embodiment, to each pusher 49 a corresponding counter-pusher 50 (or contrast 50) is associated which is arranged on the opposite side of the pusher 49 (i.e. located above the assembly conveyor 46) and engages a top wall of the corresponding bottom shell 3 during the lifting of the bottom shell 3 (i.e. during ejection of the bottom shell 3 from the corresponding seat 28) to accompany the movement of the bottom shell 3 itself. In other words, during the lifting each bottom shell 3 is "pinched" at the bottom and at the top by the corresponding pusher 49 and counter-pusher 50 to be always stably and firmly driven, and therefore preventing unwanted movements of the bottom shell 3 itself.

Each pusher 49 is located below the fill conveyor 25 and is vertically movable for resting on a lower wall of a corresponding bottom shell 3; each counter-pusher 50 is located above the fill conveyor 25 and is vertically movable for resting on an upper wall of a corresponding bottom shell 3 from the opposite side with respect to a corresponding pusher 49.

Figure 11:
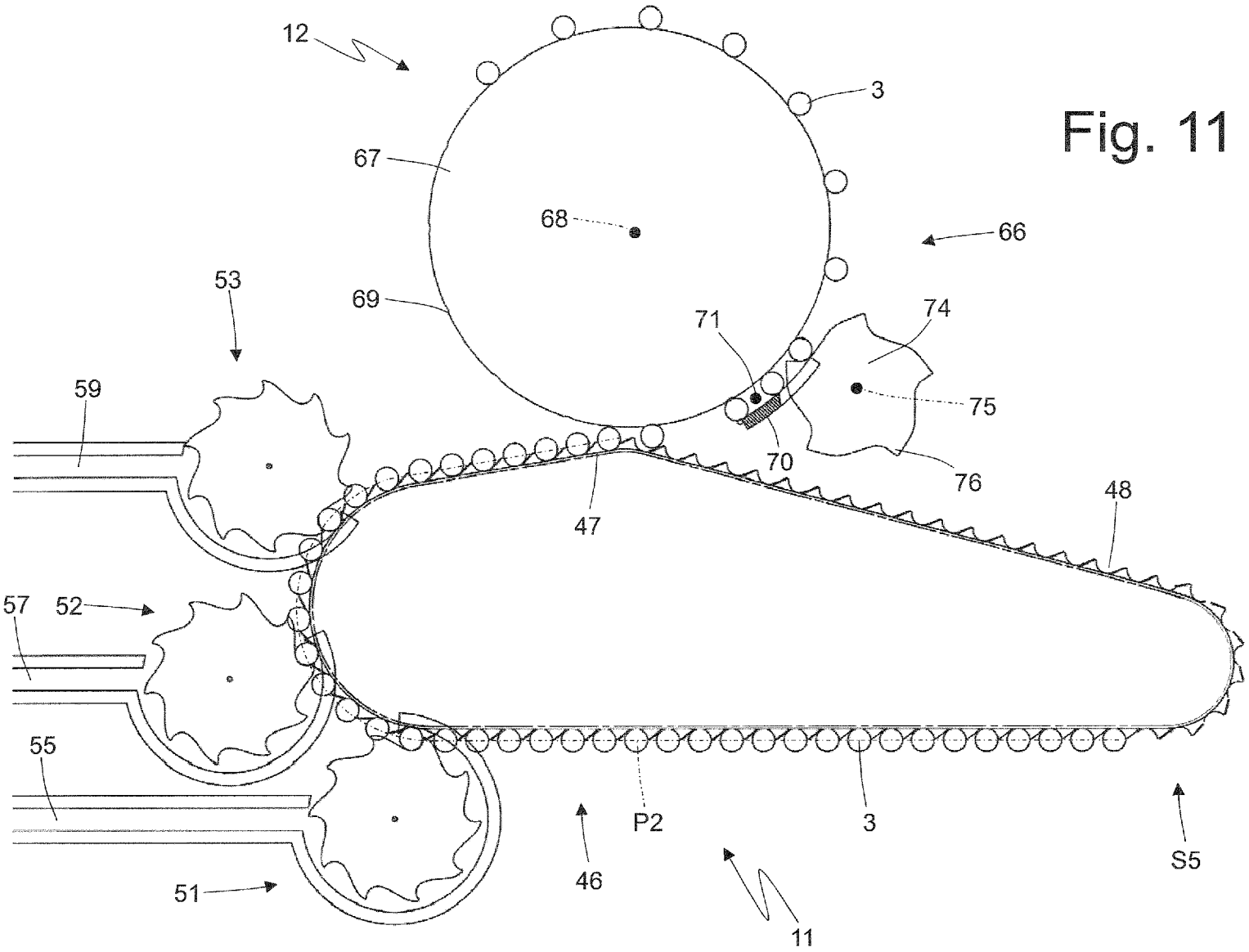
FIG. 11 is a schematic and a plan view of the assembly unit and of a part of the labelling unit of FIG. 10.

As illustrated in FIGS. 10 and 11, along the assembly path P2 and around a circular portion of the assembly conveyor 46 an assembly device 51 for fitting each bottom shell 3 with a corresponding gasket 6, an assembly device 52 for fitting each bottom shell 3 with a corresponding top cap 7, and an assembly device 53 for fitting each bottom shell 3 with a corresponding bottom cap 5 are arranged in succession.

As illustrated in FIGS. 1 and 2, the gaskets 6 are fed to the assembly device 51 from a storage unit 54 by means of a corresponding feed conveyor 55, the top caps 7 are fed to the assembly device 52 from a storage unit 56 by means of a corresponding feed conveyor 57, and the bottom caps 5 are fed to the assembly device 53 from a storage unit 58 by means of a corresponding feed conveyor 59.

As illustrated in FIGS. 13-16, the assembly device 51 comprises a support plane 60, which is located above the assembly conveyor 46, is movable horizontally (i.e. it moves to the right and to the left while staying at the same distance from the assembly conveyor 46), provides a temporary support to the gasket 6 before fitting the seal 6 itself to a corresponding bottom shell 3, and moves to allow fitting the corresponding seal 6 to the bottom shell 3. Moreover, the assembly device 51 comprises an inserter element 61, which is located above the support plane 60, is movable vertically (i.e. towards and away from the assembly conveyor 46) and moves downwards with a first stroke to engage the seal 6 resting on the support plane 60 and with a subsequent second stroke for fitting the seal 6 to the bottom shell 3 after the support plane 60 has moved freeing access to the bottom shell 3 itself.

Figure 13:
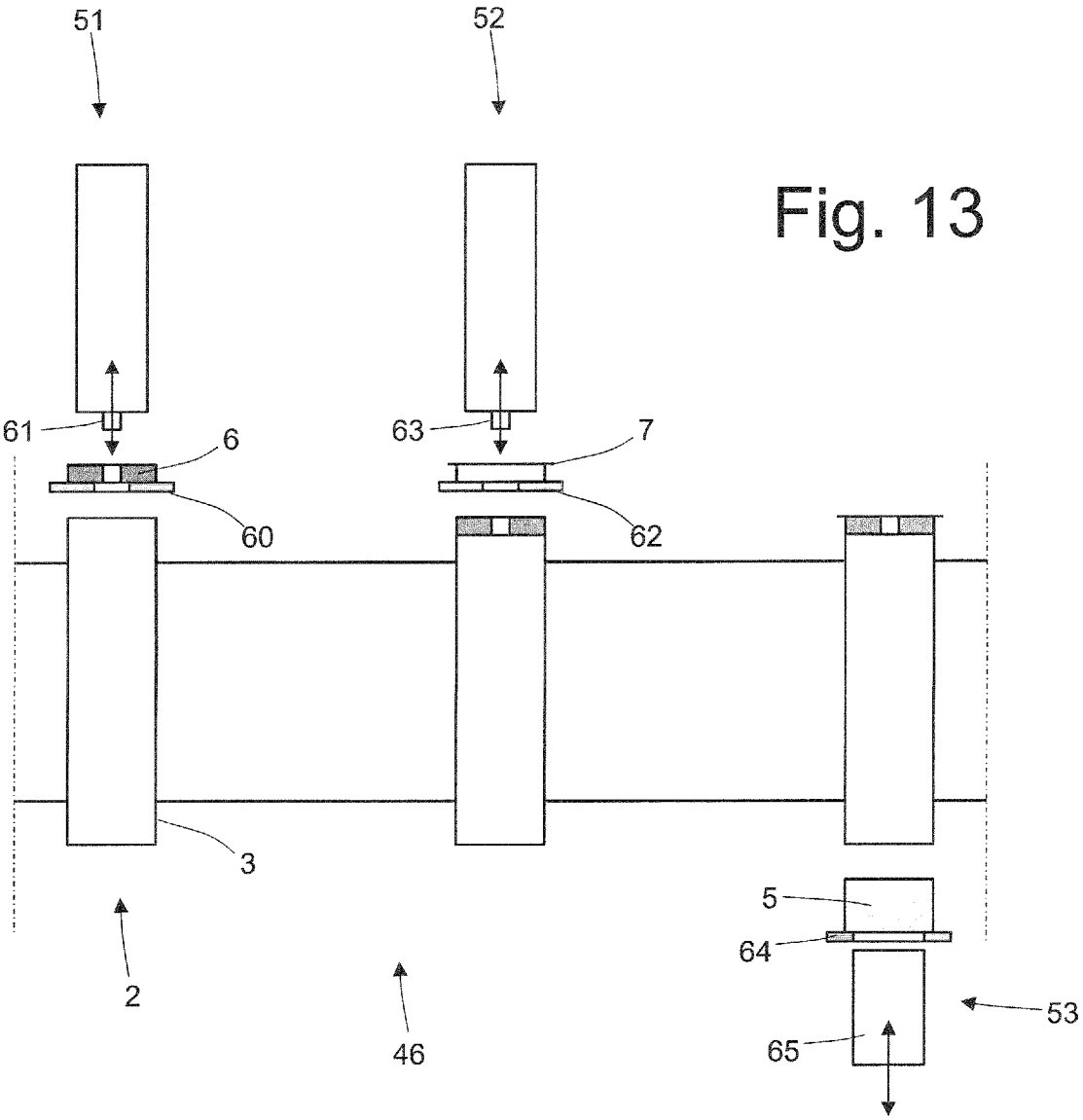
FIGS. 13-16 are four schematic views showing four different operating steps of the feed devices of the assembly unit of FIG. 10.
Figure 14:
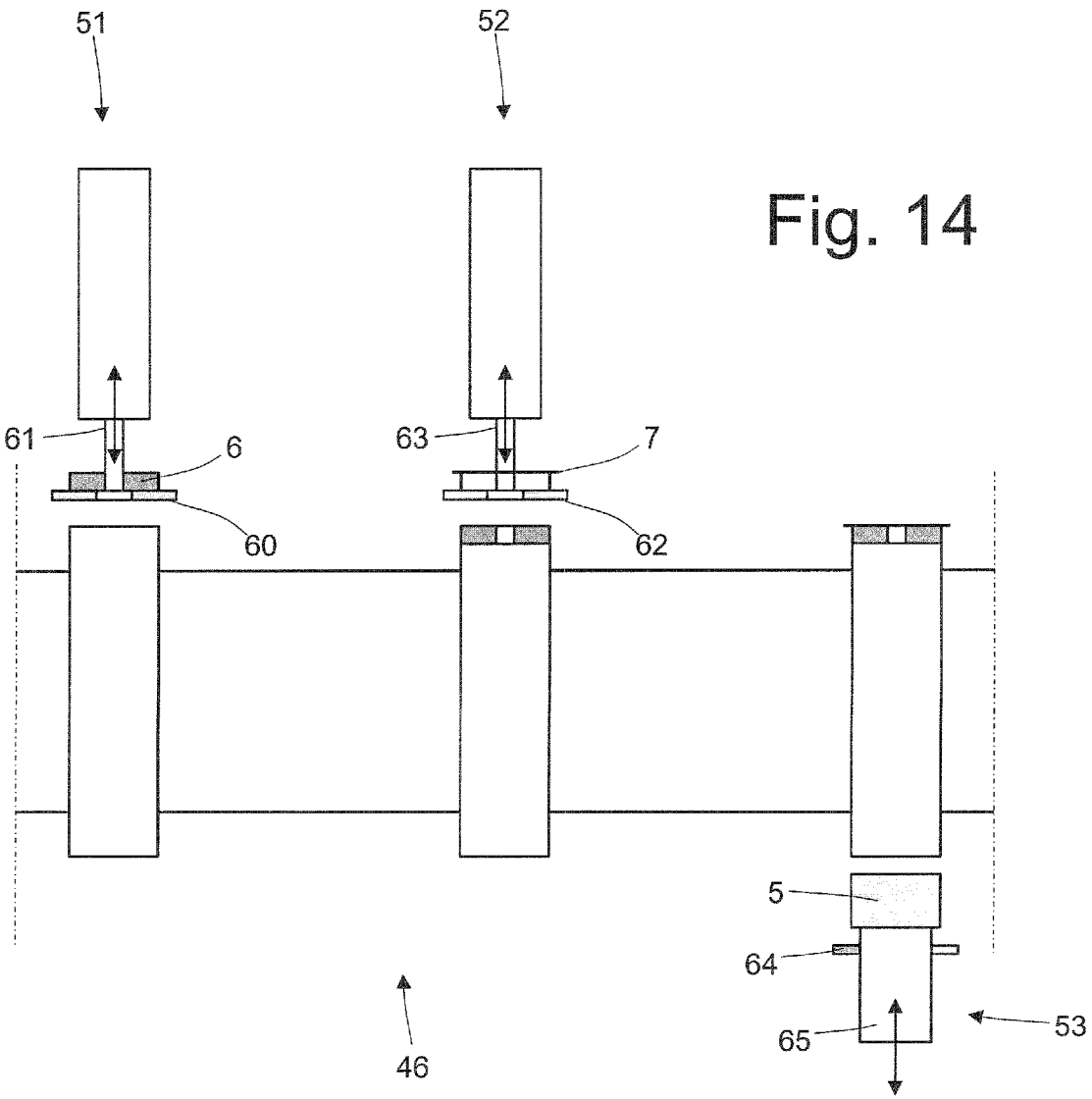
Figure 15:
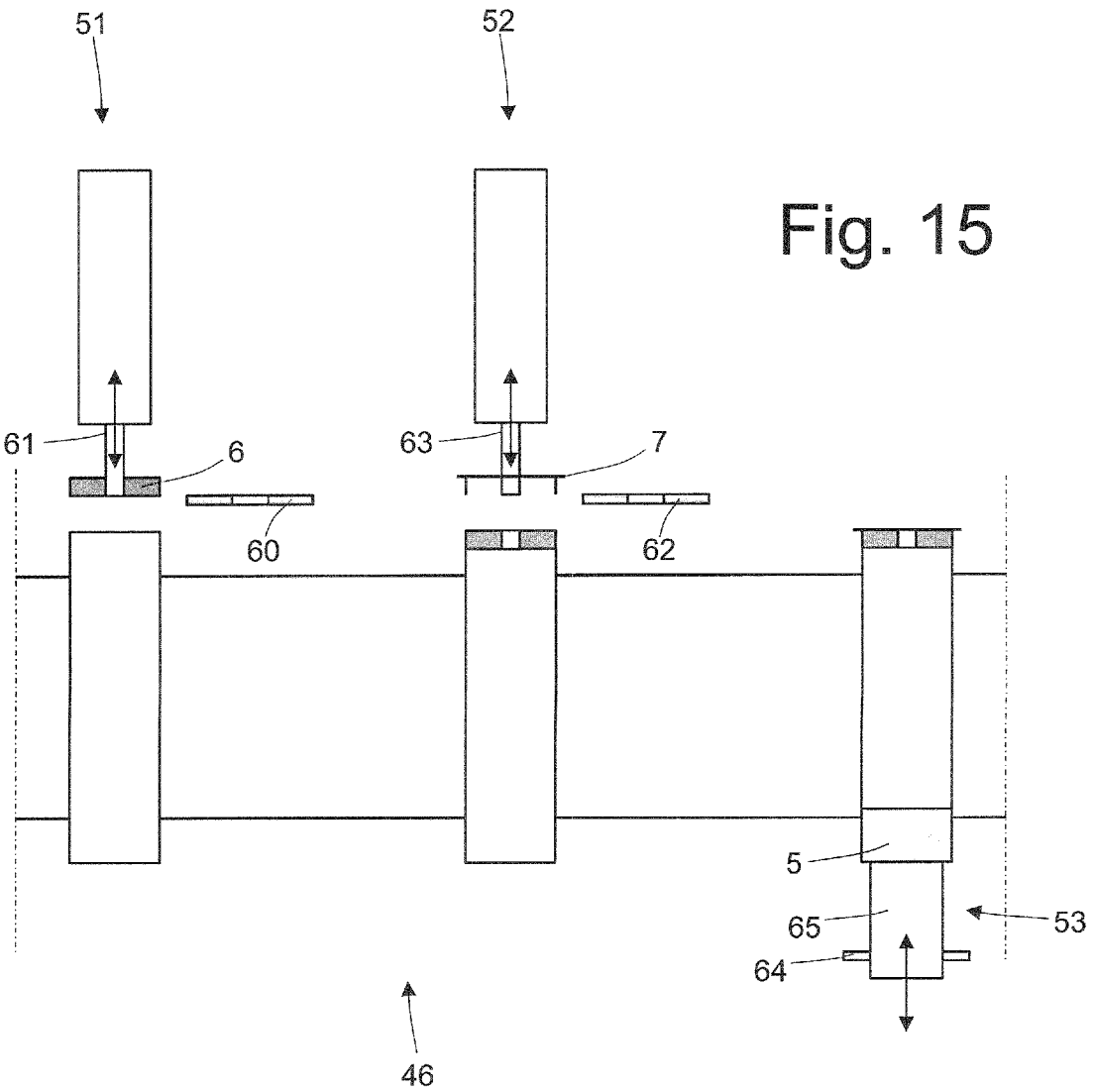
Figure 16:
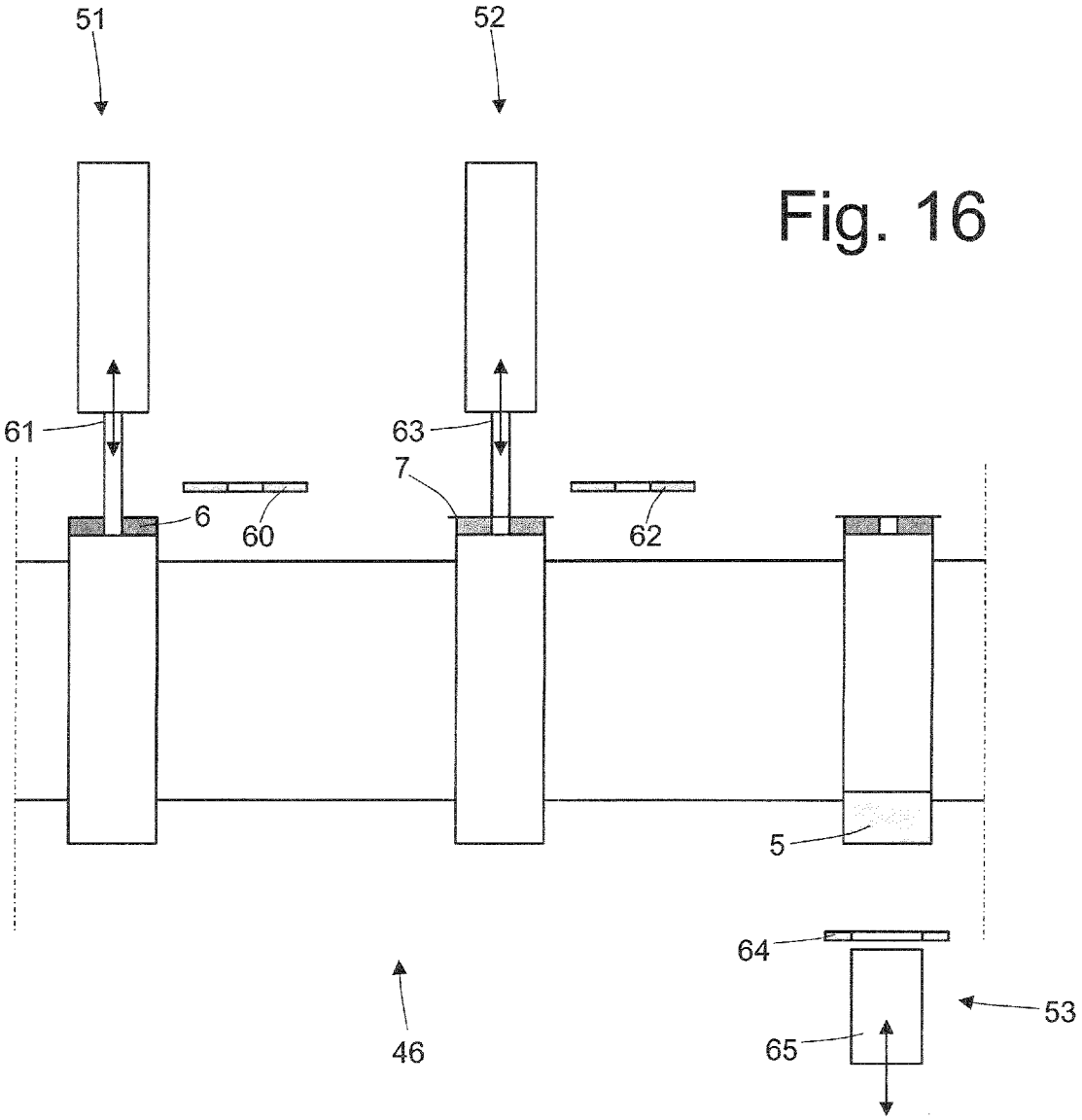

When a bottom shell 3 arrives at the level of the assembly device 51, the feed conveyor 55 deposits a corresponding gasket 6 on the support plane 60 that is located above the bottom shell 3 itself (as shown in FIG. 13). At this point, the inserter element 61 is lowered making the first stroke downwards to engage a center hole of the gasket 6, i.e. to fit inside the central hole of the gasket 6 (as illustrated in FIG. 14); preferably a bottom end of the inserter element 61 is point-shaped to have a self-centering function with respect to the central hole of the gasket 6. Thus, the support plane 60 moves laterally to free access to the underlying bottom shell 3 while the gasket 6 remains in the same position as engaged by the inserter element 61 (as shown in FIG. 15). Finally, the inserter element 61 is further lowered making the second downwards stroke to insert the seal 6 into the bottom shell 3 (as shown in FIG. 16).

The assembly device 52 is entirely similar to the assembly device 51 and therefore comprises a support plane 62, which is located above the assembly conveyor 46, is movable horizontally (i.e., it moves to the right and to the left while staying at the same distance from the assembly conveyor 46), provides a temporary support to the top cap 7 before fitting the top cap 7 itself to a corresponding bottom shell 3, and moves to allow the fitting of the bottom shell 3 with a corresponding top cap 7. Furthermore, the assembly device 53 comprises an inserter element 63, which is located above the support plane 62, is vertically movable (i.e. towards and away from the assembly conveyor 46) and moves downwards with a first stroke for engaging the top cap 7 resting on the support floor 62 and with a subsequent second stroke for fitting the top cap 7 to the bottom shell 3 after the support plane 62 has moved freeing access to the bottom shell 3 itself.

The assembly device 53 is similar to the assembly devices 51 and 52 and comprises a support plane 64, which is located below the assembly conveyor 46, is fixed, and provides a temporary support to the bottom cap 5 before the application of the bottom cap 5 itself to a corresponding bottom shell 3 overhead. Furthermore, the assembly device 53 comprises an inserter element 65, which is located below the support plane 64, is vertically movable (i.e. towards and away from the assembly conveyor 46) and moves upwards with a single stroke to engage the bottom cap 5 resting on the support plane 64 and then fit the cap bottom 5 to the bottom shell 3 by passing through the support plane 64.

According to a preferred embodiment, immediately upstream from the assembly device 53 a control device is arranged adapted to determine the correct operation of the electric circuit located inside each bottom shell 3 (for example to determine whether said electric circuit has electric continuity i.e. is not prematurely electrically interrupted). In this way, before applying the bottom cap 5 to each bottom shell 3, the proper operation of the electric circuit located inside each bottom shell 3 is checked. It is important to note that if before the assembly process a bottom shell 3 with a problem in the circuit is detected (i.e. a defective bottom shell 3 to be discarded), then the caps 5 and 7 and the seal 6 are not fitted with said defective bottom shell 3.

According to a preferred embodiment, along the assembly conveyor 46 and downstream from the assembly devices 51-53 an optical control device (such as a CCD camera) is arranged that verifies the correct conformation of bottom shells 3 identifying any defective bottom shells 3 (e.g. bottom shells wherein the cap 5 and/or the cap 7 are not arranged correctly or damaged bottom shells 3).

Figure 18:
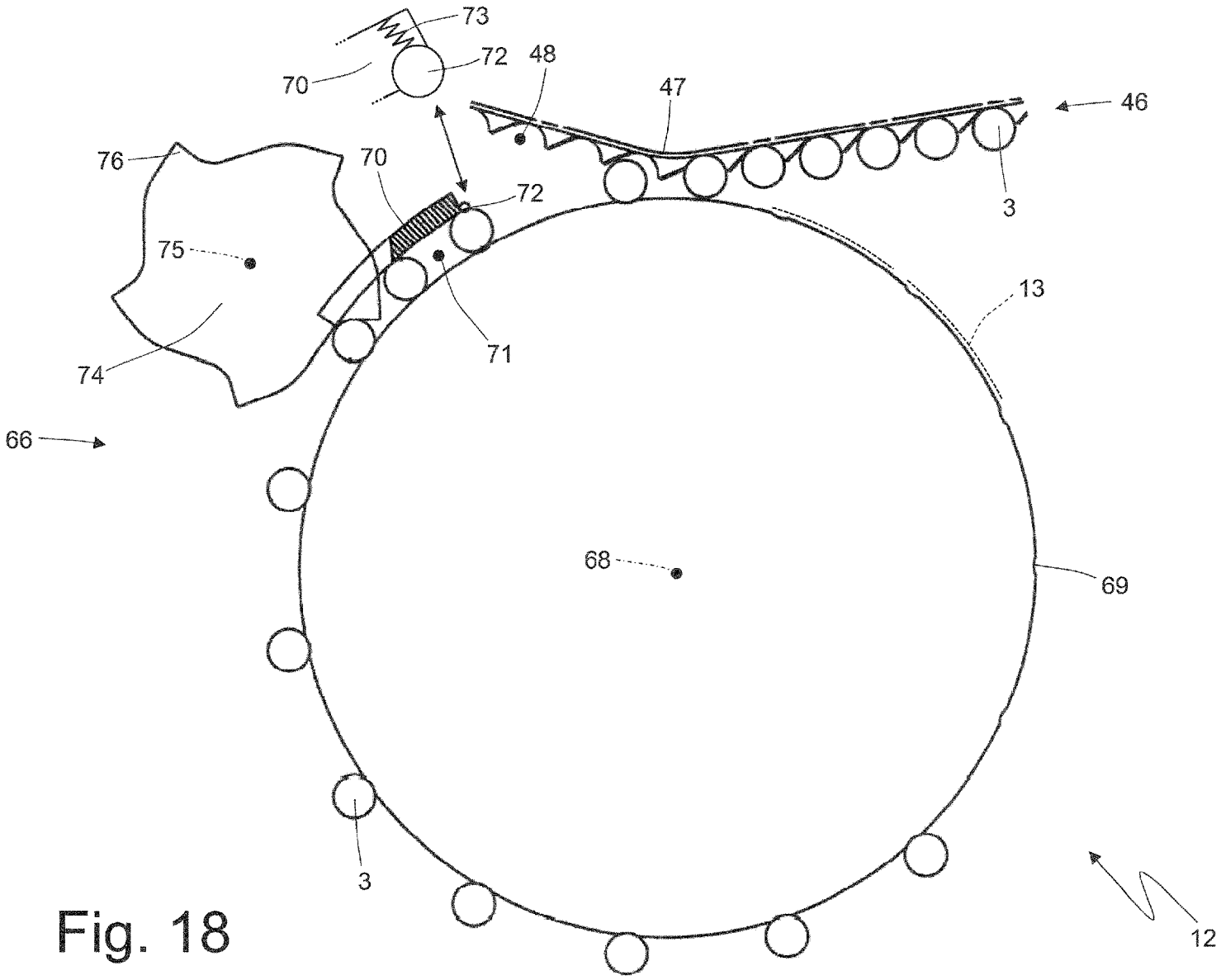
FIG. 18 is a schematic plan view of a first labelling conveyor of the labelling unit of FIG. 10.

As illustrated in FIGS. 11 and 18, the labelling unit 12 comprises a labelling device 66, which is located downstream from the assembly conveyor 46 and applies around a side surface of each bottom shell 3 a corresponding main label 13. The labelling device 66 comprises a labelling wheel 67, which rotates with continuous motion around a horizontal axis of rotation 68, is tangent to the assembly conveyor 46, and receives bottom shells 3 directly from the assembly conveyor 46 itself (so by passing from the assembly conveyor 46 to the labelling wheel 67 the bottom shells pass from intermittent motion of the assembly conveyor 46 to continuous motion of the labelling wheel 67). The labelling wheel 67 is provided with a number of suction seats 69, each of which is formed at a cylindrical side surface of the labelling wheel 67 and is adapted to retain a corresponding main label 13 provided with glue (which is applied to the main label 13 upstream from the labelling wheel 67) and a corresponding bottom shell 3 which is subsequently placed over the main label 13.

Furthermore, the labelling unit 12 comprises a rolling plate located alongside the labelling wheel 67 to define a rolling channel 71 inside which each bottom shell 3 is made to rotate on itself by rolling on the outer surface of the labelling wheel 67 so as to determine the wrapping around the bottom shell 3 of the corresponding main label 13. According to a preferred embodiment, the rolling plate 70 comprises a tooth 72, which is located at a front end of the rolling channel 71 (or the inlet of the rolling channel 71), protruding internally to the rolling channel 71 locally reducing the size of the rolling channel 71 itself, and is mounted radially movable against the thrust of elastic means 73; the function of the tooth 72 is to slightly compress each bottom shell 3 at the inlet of the rolling channel 71 so as to facilitate the ejection of the bottom shell 3 from the corresponding seat 69 of the labelling wheel 67 and then start the rolling of the bottom shell 3 itself. The presence of the elastic means 73 is particularly useful, since the bottom shells 3 are not substantially elastically compressible and therefore it is preferable that is the tooth 72 to yield moving inwards when a bottom shell 3 enters the rolling channel 71 and therefore impacts against the tooth 72.

According to a preferred embodiment the labelling device 66 comprises a resetting drum 74 located alongside the labelling wheel 67 immediately downstream from the rolling plate 70 and has a series of teeth 76 which engage the bottom shells 3 exiting from rolling channel 71 to arrange the bottom shells 3 itself in a predetermined relative position with respect to labelling wheel 67, or to arrange bottom shells 3 inside the corresponding seats 69 of the labelling wheel 67 once exited from the rolling channel 71.

According to a possible embodiment, it may be necessary to ensure a certain relative position between each bottom shell 3 and the corresponding main label 13 (normally when the main label 13 has a through hole that must be aligned with an underlying opening formed in the cylindrical lateral surface of the bottom shell 3); in this case, the assembly conveyor 46 is coupled to an orienting device that optically detects the angular position of each bottom shell 3, and then acts mechanically on the bottom shell 3 by imparting a rotation to the bottom shell 3 to put the bottom shell 3 itself in a desired and predetermined angular position. In this way, the bottom shells 3 enter into the labelling wheel 67 always and only with the desired and predetermined angular position which ensures the respect of the desired relative position between each bottom shell 3 and the corresponding main label 13.

Figure 17:
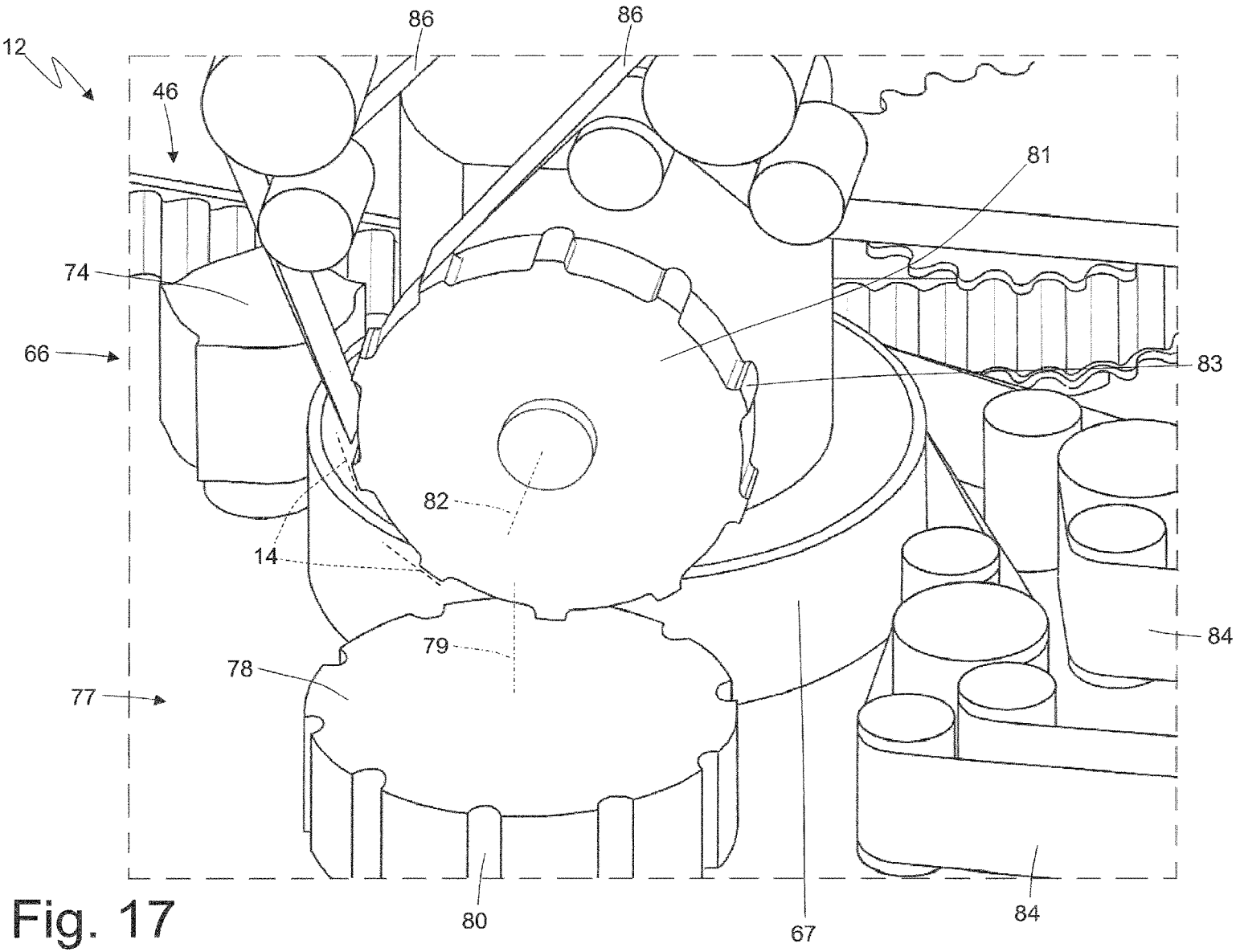
FIG. 17 is a schematic perspective view of the labelling unit of FIG. 10.

As illustrated in FIG. 17, the labelling unit 12 comprises a labelling device 77, which is located downstream from the labelling device 66 and apply on a top wall of each bottom shell 3 (i.e. over the corresponding top cap 7) a corresponding sealing label 14. The labelling device 77 comprises a labelling wheel 78, which rotates with continuous motion around a vertical axis of rotation 79, is tangent to the labelling wheel 67, and receives the bottom shells 3 directly from the labelling wheel 67 itself. The labelling wheel 78 is provided with a number of suction seats 80, each of which is formed at a cylindrical lateral surface of the labelling wheel 78 and is adapted to retain a corresponding bottom shell 3. Furthermore, the labelling device 77 comprises an application wheel 81, which is located above the labelling wheel 78, is oriented perpendicularly to the labelling wheel 78, and rotates with continuous motion around a horizontal axis of rotation 82. The application wheel 81 is provided with a number of suction seats 83, each of which is formed at a cylindrical lateral surface of the application wheel 81 and is adapted to retain a corresponding sealing label 14. In use, each suction seat 83 of the application wheel 81 receives a corresponding label 14 and then applies the sealing label 14 itself on a top wall of each bottom shell 3 (i.e. over the corresponding top cap 7) carried by a seat 80 of the labelling wheel 78. The labelling wheel 78 is coupled to a movable folding device (not shown) provided with two degrees of freedom, which is located downstream from the application wheel 81 in the rotation direction of the labelling wheel 78 and L-folds each sealing label 14 completely to adhere the sealing label 14 itself to the corresponding bottom shell 3.

According to a preferred embodiment illustrated in FIG. 17, the main labels 13 are self-adhesive, i.e. originally already provided with glue on an inner face, and are withdrawn by two corresponding tapes 84 that are used alternatively to ensure operation continuity (i.e. when tape 84 is exhausted the other tape 84 is used and in the meantime the exhausted tape 84 is replaced with a new tape 84). According to a preferred embodiment illustrated in FIGS. 1 and 2, the tapes 84 are unwound from corresponding spools supported by an unwinding device 85 of known type. According to a preferred embodiment illustrated in FIG. 17, the sealing labels 14 are self-adhesive, or are originally already provided with glue on an inner face, and are withdrawn by two corresponding tapes 86 that are used alternatively to ensure the continuity of the operation (i.e. when a tape 86 is exhausted the other tape 86 is used and in the meantime the exhausted tape 86 is replaced with a new tape 86). According to a preferred embodiment illustrated in FIGS. 1 and 2, the tapes 86 are unwound from corresponding spools supported by an unwinding device 87 of known type.

According to a preferred embodiment, downstream from the labelling devices 66 and 77 an optical control device (such as a CCD camera) is arranged that verifies the correct conformation of the cartridges 2 identifying any defective cartridges 2.

According to a preferred embodiment, downstream from the labelling devices 66 and 77 a discharge station of known type is arranged in which the cartridges 2 that have been recognized as defective by the control devices located upstream (i.e. the cartridges 2 whose bottoms shells 7, caps 5 and 7, and/or labels 13 and 14 show functional and/or visible defects) are discarded or eliminated from the production process.

From what has been described above and well-illustrated in FIG. 10, in the fill unit 10 the fill conveyor 25 feeds along the fill path P1 a row of bottom shells 3 with intermittent motion, which consists of ten bottom shells 3 (i.e. by at least two bottom shells 3) aligned perpendicularly to the fill path P1 so as to feed along the fill path P1 itself ten bottom shells 3 (i.e. at least two bottom shells 3) at a time; each row of ten bottom shells 3 is housed in corresponding seats 28 of a cartridge-holder 27 of the fill conveyor 25. Instead, in the assembly unit 11 the assembly conveyor 46 feeds along the assembly path P2 a single bottom shell 3 at a time with intermittent motion. Obviously, at each feed step of the fill conveyor 25 the assembly conveyor 46 has to make ten feed steps, as in the transfer station S5 the assembly conveyor 46 receives ten bottom shells 3 at a time from the fill conveyor 25. Finally, in the labelling units 12 the labelling wheels 67 and 78 move with continuous motion a single bottom shell 3 at a time.

From what has been described above and well-illustrated in FIG. 10, the assembly path P2 of the assembly conveyor 46 is arranged perpendicularly to the fill path P1 of the fill conveyor 25. Furthermore, the assembly path P2 of the assembly conveyor 46 extends in a vertical plane and the fill path P1 of the fill conveyor 25 extends in a horizontal plane.

In summary, machine 1 for producing electronic-cigarette cartridges 2; the machine comprising: a fill conveyor 25 which feeds bottom shells 3 of the cartridge 2 along a fill path P1; a filling device 38 located along the fill path P1 to feed a measure of a liquid substance downwards into each bottom shell 3; an assembly conveyor 46 which feeds bottom shells 3 along an assembly path P2; a transfer station S5 in which the bottom shells 3 are transferred from the fill conveyor 25 to the assembly conveyor 46; and at least a first assembly device 52 located along the assembly path P2 for fitting each bottom shell 3 with a corresponding top cap 7; in the machine 1 the fill conveyor 25 feeds along the fill path P1 a row of bottom shells 3 comprising at least two bottom shells 3 aligned perpendicularly to the fill path P1 so as to feed along the fill path P1 itself at least two bottom shells 3 at a time; and the assembly conveyor 46 feeds along the assembly path P2 a single bottom shell 3 at a time.

The assembly path P2 is arranged perpendicular to the fill path P1.

The assembly path P2 extends in a vertical plane and the fill path P1 extends in a horizontal plane.

The fill conveyor 25 comprises a first belt conveyor 26 and a number of cartridge-holders 27, each of which is fixed to the first belt conveyor 46 and has at least one row of seats 28 arranged perpendicular to the fill path P1 to house a corresponding row of bottom shells 3 that are simultaneously fed along the fill path P1 itself.

Each cartridge-holder 27 has a bottom wall provided with a through hole at each seat 28.

The filling device 38 is located along a straight horizontal portion of the fill path P1; a first weighing device 42 is provided which is adapted to weigh each bottom shell 3 and is located upstream from the filling device 38 along the straight horizontal portion of the fill path P1; a second weighing device 42 is provided which is adapted to weigh each bottom shell 3 and is located downstream from the filling device 38 along the straight horizontal portion of the fill path P1; and each weighing device 42 comprises a first lifting device, which is adapted to lift each bottom shell 3 vertically ejecting the bottom shell 3 itself from the corresponding seat 28 of the cartridge-holder 27 and, which is connected mechanically with a weight sensor 44 which detects the total weight of the bottom shell 3 when the bottom shell 3 is fully ejected from the corresponding seat 28.

The first lifting device of each weighing device 42 comprises: a first pusher 43 which is located below the fill conveyor 25, is vertically movable for resting on a lower wall of a corresponding bottom shell 3, and, which is connected mechanically to the weight sensor 44; and a first counter-pusher 45 which is located above the fill conveyor 25, is vertically movable for resting on a top wall of a corresponding bottom shell 3 from the opposite side with respect to the first pusher 43, and is adapted to be separated temporarily from the top wall itself during the measuring of the weight of the bottom shell 3.

One end of the assembly conveyor 46 is located above a straight horizontal portion of the fill path P1; and the transfer station S5 comprises a second lifting device, which is adapted to vertically lift each bottom shell 3 to transfer the same bottom shell 3 from the fill conveyor 25 to the overlying assembly conveyor 46.

The second lifting device of the transfer station S5 comprises: a second pusher 49 which is located below the fill conveyor 25 and is vertically movable for resting on a lower wall of a corresponding bottom shell 3; and a second counter-pusher 50 which is located above the fill conveyor 25 and is vertically movable for resting on a top wall of a corresponding bottom shell 3 from the opposite side of the second pusher 49.

The assembly conveyor 46 comprises a second belt conveyor 47 that is arranged vertically and supports a number of seats 48, each of which is adapted to contain and hold a corresponding bottom shell 3.

The first assembly device 52 comprises: a support plane 62, which is located above the assembly conveyor 46, is horizontally movable, provides a temporary support to the top cap 7 before applying the top cap 7 itself to a corresponding bottom shell 3, and moves to allow fitting the bottom shell 3 with a corresponding top cap 7; an inserter element 63, which is located above the support plane 62, is vertically movable and moves downwards with a first stroke for engaging the top cap 7 resting on the support plane 62 and with a subsequent second stroke for fitting the top cap 7 with the bottom shell 3 after the support plane 62 has moved freeing access to the bottom shell 3 itself.

The machine 1 further comprising: a second assembly device 51 located along the assembly path P2 upstream from the first assembly device 52 for fitting each bottom shell 3 with a corresponding insert 6; and a third assembly device 53 located along the assembly path P2 for fitting each bottom shell 3 with a corresponding bottom cap 5 arranged on the opposite side of the top cap 7.

The machine 1 further comprising a first labelling device 66, which is located downstream from the assembly conveyor 46 and applies around a lateral surface of each bottom shell 3 a corresponding first label 13.

The first labelling device 66 comprises: a first labelling wheel 67 provided with a number of suction seats 69, each of which is adapted to retain a corresponding first label 13 provided with glue and a corresponding bottom shell 3 which is placed over the first label 13; and a rolling plate 70 located alongside the first labelling wheel 67 to define a rolling channel 71 inside which each bottom shell 3 is made to rotate on itself by rolling on the outer surface of the first labelling wheel 67 so as to determine the wrapping of the corresponding first label 13 around the bottom shell 3.

The rolling plate 70 comprises a tooth 72, which is located at a front end of the rolling channel 71, protrudes inside the rolling channel 71 locally reducing the size of the rolling channel 71 itself, and is mounted radially movable against the thrust of elastic means 73.

The first labelling device 66 comprises a resetting drum 74 located alongside the first labelling wheel 67 immediately downstream from the rolling plate 70 and has a series of teeth which engage the bottom shells 3 exiting the rolling channel 71 to arrange the bottom shells 3 itself in a predetermined relative position with respect to the first labelling wheel 67.

The machine 1 further comprising a second labelling device 77, which is located downstream from the first labelling device 66 and applies on an top wall of each bottom shell 3 a corresponding second label 14.

The second labelling device 77 comprises: a second labelling wheel 78, which is provided with a number of suction seats 28, each of which is adapted to retain a corresponding bottom shell 3; and an application wheel 81, which is located above the second labelling wheel 78, is oriented perpendicularly to the second labelling wheel 78, and is provided with a number of suction seats 83, each of which is adapted to retain a corresponding second label 14 to apply the second label 14 itself on a top wall of each bottom shell 3 carried by the second labelling wheel 78.

The machine 1 further comprising a hopper 29 located alongside a vertical portion of the fill conveyor 25, and having at the bottom part a number of vertical channels, each for receiving and conveying a corresponding stack of bottom shells 3; and comprises a pusher 30 which is movable horizontally through the vertical channels of the hopper 29 to push a row of bottom shells 3 out of the vertical channels inside the fill conveyor 25.

The machine 1 further comprising a chute 31 which is horizontally located between the hopper 29 and the fill conveyor 25 and whereon the bottom shells 3 slide when they are pushed by the pusher 30 towards the fill conveyor 25; and comprises a number of controllable hatches 32 which are obtained through the chute 31 and each of which is individually openable to allow the discharge of a corresponding bottom shell 3 by deflecting the bottom shell 3 itself towards a deviation path.

The machine 1 further comprising a first feed belt conveyor 17 which feeds bottom shells 3 from the top inside the hopper 29; and it comprises a second feed belt conveyor 16 which ends above the first feed conveyor 17 and feeds the bottom shells 3 from the first feed conveyor 17 itself.

The second feed conveyor 16 is arranged horizontally inclined to feed the bottom shells 3 from the bottom upwards along an inclined plane.

The second feed conveyor 16, is provided with pockets 22, each adapted to contain a corresponding bottom shell 3.

The machine 1 further comprising an optical control device 23 located along the second feed conveyor 16 and is adapted to determine the orientation of the bottom shells 3 inside the pockets 22 of the second feed conveyor 16 itself; and comprises an ejecting device 24 that is located along the second feed conveyor 16 downstream from the optical control device 23 and is adapted to eject from the corresponding pocket 22 of the second feed conveyor 16 each bottom shell 3 which is wrongly oriented.

The machine 1 further comprising a third belt feed conveyor 15 that ends above the second feed conveyor 16 to feed the bottom shells 3 from the top to the first feed conveyor 17 itself.

The third feed conveyor 15 is arranged horizontally inclined to feed the bottom shells 3 from the bottom upwards along an inclined plane.

The third feed conveyor 15 and an initial portion of the second feed conveyor 16 are located inside a collecting tank 9 open at the top and adapted to receive a mass of bottom shells 3 arranged in bulk.

An orienting grid 21 is located between a trailing end of the third feed conveyor 15 and a leading end of the second feed conveyor 16.

The present invention also relates to a method for producing electronic-cigarette cartridges 2; the method comprises the steps of: feeding the bottom shells 3 of the cartridges 2 along a fill path P1 of the fill conveyor 25; feeding a measure of a liquid substance inside each bottom shell 3 by means of a filling device 38 located along the fill path P1; transferring the bottom shells 3 from the fill conveyor 25 to an assembly conveyor 46 at a transfer station S5; feeding the bottom shells 3 along an assembly path P2 by means of the assembly conveyor 46; and fitting each bottom shell 3 with at least one corresponding top cap 7 by means of an assembly device 52 located along the assembly path P2; the fill conveyor 25 feeds along the fill path P1 a row of bottom shells 3 comprising at least two bottom shells 3 aligned perpendicularly to the fill path P1 so as to feed along the fill path P1 itself at least two bottom shells 3 at a time; and the assembly conveyor 46 feeds along the assembly path P2 one single bottom shell 3 at a time.

The machine 1 described above has numerous advantages.

First, the machine 1 described above allows to achieve high productivity (that is, a number of pieces produced in the time unit) while ensuring a high quality standard of the cartridges 2. This result is obtained thanks to the fact of making the fill unit 10 operate in parallel, i.e. by feeding along the fill path P1 itself at least two bottom shells 3 at a time which are processed simultaneously, and to operate the assembly unit 11 and the labelling unit 12 in series, i.e. feeding along the assembly path P2 one single bottom shell 3 at a time; in this way, all processes (filling, assembling, labelling) can take place in the most favorable conditions. In fact, the filling of bottom shells 3 requires a long enough time to take place in an optimal way, and then is performed in parallel (i.e. by filling more bottom shells 3 at a time the available time for the filling each bottom shell 3 is multiplied); it is important to note that by having a lot of time available the liquid substance can enter in the bottom shells 3 by gravity (i.e. at atmospheric pressure without overpressures) and in this way, the filling of bottom shells is done in an optimal way allowing to obtain a perfect impregnation of the hygroscopic pads 4, avoiding unwanted deformations of the bottom shells 3 and/or of the hygroscopic pads 4, and avoiding leakage of the liquid substance from bottom shells 3. Instead, the assembly and labelling operations can be done in a much more rapid way (while retaining effectiveness and quality) and would be very complex to be performed in parallel having the need to fit the solid elements (i.e. non-liquid, that is, the gaskets 6, caps 5 and 7 and the labels 13 and 14) external to the bottom shells 3.

In addition, the machine 1 described above is also easy and inexpensive to manufacture, as it is composed of structurally simple elements performing few movements and easy to implement.

Finally, the machine 1 described above provides adequate space for maneuvering around each component, and then both the initial assembly of the components and the subsequent maintenance (from simple cleaning to the replacement) of the components themselves are simplified.

The invention claimed is:

1. A machine (1) for producing electronic-cigarette cartridges (2); the machine comprising:

a fill conveyor (25) which feeds bottom shells (3) of the cartridges (2) along a fill path (P1);

a filling device (38) located along a straight horizontal portion of the fill path (P1) to feed a measure of a liquid substance downwards into each bottom shell (3);

a first weighing device (42) for weighing each bottom shell (3) arranged upstream from the filling device (38), along the straight horizontal portion of the fill path (P1);

second weighing device (42) for weighing each bottom shell (3) arranged downstream from the filling device (38) along the straight horizontal portion of the fill path (P1);

an assembly conveyor (46) which feeds bottom shells (3) along an assembly path (P2);

a transfer station (S5) where the bottom shells (3) are transferred from the fill conveyor (25) to the assembly conveyor (46); and at least a first assembly device (52) located along the assembly path (P2) to fit each bottom shell (3) with a corresponding top cap (7);

wherein the fill conveyor (25) feeds along the fill path (P1) a row of bottom shells (3) comprising at least two bottom shells (3) aligned perpendicularly to the fill path (P1), so as to feed at least two bottom shells (3) at a time along, and transversely to, the fill path (P1);

wherein the assembly conveyor (46) feeds one bottom shell (3) at a time along the assembly path (P2); and wherein each weighing device (42) comprises a first lifting device, for lifting and ejecting each bottom shell (3) vertically from the corresponding seat (28) in the cartridge-holder (27) and, which is connected mechanically with a weight sensor (44) for determining the total weight of the bottom shell (3) when the bottom shell (3) is fully ejected from the corresponding seat (28).

2. The machine (1) according to claim 1, wherein:

a belt (47) of the assembly conveyor (46) is wound ring-like around two end pulleys having different diameters and arranged horizontally;

the assembly path (P2) extends in a vertical plane; and the fill path (P1) extends in a horizontal plane.

3. The machine (1) according to claim 1, wherein the fill conveyor (25) comprises a first conveyor belt (26) and a number of cartridge-holders (27), each of which is fixed to the first conveyor belt (26) and having at least one row of seats (28), which is perpendicular to the fill path (P1) to house a corresponding row of bottom shells (3) which are fed simultaneously along the fill path (P1).

4. The machine (1) according to claim 1, wherein the first lifting device of each weighing device (42) comprises:

a first pusher (43) which is located below the fill conveyor (25), is vertically movable for resting on a lower wall of a corresponding bottom shell (3), and, which is connected mechanically to the weight sensor (44); and a first counter-pusher (45) which is located above the fill conveyor (25), is vertically movable for resting on an upper wall of a corresponding bottom shell (3) from the opposite side with respect to the first pusher (43), and is adapted to be separated temporarily from the upper wall itself during the measuring of the weight the bottom shell (3).

5. The machine (1) according to claim 1, wherein:

one end of the assembly conveyor (46) is located above a straight horizontal portion of the fill path (P1); and the transfer station (S5) comprises a second lifting device for lifting each bottom shell (3) vertically and transferring the bottom shell (3) from the fill conveyor (25) to the assembly conveyor (46) overhead.

6. The machine (1) according to claim 1, wherein:

the assembly conveyor (46) comprises a second conveyor belt (47) which is arranged vertically and supports a number of seats (48), each of which is adapted to contain and hold a corresponding bottom shell (3); and the first assembly device (52) comprising:

a support plane (62), which is located above the assembly conveyor (46) is movable horizontally, provides a temporary support to the top cap (7) before applying the top cap (7) itself to a corresponding underlying pad (3), and moves to allow coupling a corresponding top cap (7) to the bottom shell (3); and an inserter element (63), which is located above the support plane (62), is movable vertically and moves downward with a first stroke for engaging the top cap (7) resting on the support plane (62) and with a subsequent second stroke for coupling the top cap (7) to the bottom shell (3) after the support plane (62) has moved freeing access to the bottom shell (3) itself.

7. The machine (1) according to claim 1 and comprising:

a second assembly device (51) located along the assembly path (P2) upstream from the first assembly device (52) to fit each bottom shell (3) with a corresponding insert (6); and a third assembly device (53) located along the assembly path (P2) to fit each bottom shell (3) with a corresponding bottom cap (5) located at the opposite end to the top cap (7).

8. The machine (1) according to claim 1 and comprising a first labelling device (66), located downstream from the assembly conveyor (46) and which applies a corresponding first label (13) around a lateral surface of each bottom shell (3).

9. The machine (1) according to claim 8, wherein the first labelling device (66) comprises:

a first labelling wheel (67) provided with a number of suction seats (69), each of which is adapted to retain a corresponding first label (13) provided with glue and a corresponding bottom shell (3) which is placed over the first label (13); and a rolling plate (70) located alongside the first labelling wheel (67) to define a rolling channel (71) in which each bottom shell (3) rotates on itself thus rolling on the outer surface of the first labelling wheel (67) so as to determine the winding around the bottom shell (3) of the corresponding first label (13).

10. The machine (1) according to claim 9, wherein:

the rolling plate (70) comprises a tooth (72), which is located at a front end of the rolling channel (71), protruding internally to the rolling channel (71) and locally reducing the size of the rolling channel (71) itself, and is mounted radially movable against the thrust of elastic means (73), and the first labelling device (66) comprises a resetting drum (74) located alongside the first labelling wheel (67) immediately downstream from the rolling plate (70) and has a series of teeth (76) engaging the output bottom shells (3) from the rolling channel (71) to arrange the bottom shells (3) themselves in a predetermined relative position with respect to the first labelling wheel (67).

11. The machine (1) according to claim 1 and comprising a second labelling device (77), which is located downstream from the first labelling device (66), and which applies a corresponding second label (14) to a top wall of each bottom shell (3).

12. The machine (1) according to claim 1 and comprising:

a hopper (29) located alongside a vertical portion of the fill conveyor (25) and having a number of bottom vertical channels, each for receiving and conveying a corresponding stack of bottom shells (3); and a pusher (30) which is movable horizontally through the vertical channels of the hopper (29) to push a row of bottom shells (3) out of the vertical channels and onto the fill conveyor (25).

13. The machine (1) according to claim 12 and comprising:

a horizontal chute (31) which is located between the hopper (29) and the fill conveyor (25) and whereon bottom shells (3) slide when pushed by the pusher (30) towards the fill conveyor (25);

a number of controllable hatches (32) which are obtained through the chute (31) and each being individually openable to allow the discharge of a corresponding bottom shell (3) by deflecting the bottom shell (3) itself towards a discharge path.

14. The machine (1) according to claim 12 and comprising:

a first belt feed conveyor (17) which feeds bottom shells (3) from the top inside the hopper (29); and a second belt feed conveyor (16) that ends above the first feed conveyor (17), feeding the bottom shells (3) from above to the first feed conveyor (17) itself, is provided inclined with respect to the horizontal to feed the bottom shells (3) from the bottom upwards along an inclined plane, and is provided with pockets (22), each adapted to contain a corresponding bottom shell (3);

a third belt feed conveyor (15) that ends above the second feed conveyor (16), feeding bottom shells (3) from above to the first feed conveyor (17) itself, and is provided inclined with respect to the horizontal to feed the bottom shells (3) from the bottom upwards along an inclined plane;

a collection tank (9) which is open at the top, is adapted to receive a mass of bottom shells (3) arranged in bulk, and housing the third feed conveyor (15) and an initial portion of the second feed conveyor (16); and an orienting grid (21) located between the trailing end of the third feed conveyor (15) and a leading end of the second feed conveyor (16).

15. The machine (1) according claim 1 and comprising:

a second feed conveyor (16) provided with pockets (22);

an optical control device (23) located along the second feed conveyor (16) and adapted to determine the orientation of the bottom shells (3) inside the pockets (22); and an ejecting device (24) located along the second conveyor (16) downstream from the optical control device (23) adapted to eject each wrongly oriented bottom shell (3) from the corresponding pocket (22).

16. A method for producing electronic-cigarette cartridges (2); the method comprises the steps of:

feeding bottom shells (3) of the cartridges (2) along a fill path (P1) using a fill conveyor (25);

feeding a measure of a liquid substance downwards into each bottom shell (3) using a filling device (38) located along a straight horizontal portion of the fill path (P1);

weighing each bottom shell using a first weighing device arranged upstream from the filling device, along the straight horizontal portion of the fill path (P1);

weight each bottom shell using a second weighing device arranged downstream form the filling device, along the straight horizontal portion of the fill path (P1);

transferring the bottom shells (3) from the fill conveyor (25) to an assembly conveyor (46) at a transfer station (S5);

feeding the bottom shells (3) along an assembly path (P2) using the assembly conveyor (46); and fitting each bottom shell (3) with a corresponding top cap (7) using at least a first assembly device (52) located along the assembly path (P2);

wherein:

the fill conveyor (25) feeds along the fill path (P1) a row of bottom shells (3) comprising at least two bottom shells (3) aligned perpendicularly to the fill path (P1), so as to feed at least two bottom shells (3) at a time along, and transversely to, the fill path (P1), the assembly conveyor (46) feeds one bottom shell (3) at a time along the assembly path (P2), and each weighing device (42) comprises a first lifting device, for lifting and ejecting each bottom shell (3) vertically from the corresponding seat (28) in the cartridge-holder (27) and, which is connected mechanically with a weight sensor (44) for determining the total weight of the bottom shell (3) when the bottom shell (3) is fully ejected from the corresponding seat (28).

* * * * *